US010070721B2

(12) United States Patent
Brunnmayr et al.

(10) Patent No.: US 10,070,721 B2
(45) Date of Patent: Sep. 11, 2018

(54) DRIVE MECHANISM FOR MOVING A MOVABLE FURNITURE PART

(71) Applicant: Julius Blum GmbH, Hoechst (AT)

(72) Inventors: Harald Brunnmayr, Hoerbranz (AT); Alexander Simon Flogaus, Hoechst (AT); Hermann Haemmerle, Lustenau (AT); Michael Blum, Hoechst (AT); Bernd Koenig, Hoechst (AT); Christof Goetz, Lustenau (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 15/085,089

(22) Filed: Mar. 30, 2016

(65) Prior Publication Data

US 2016/0206093 A1 Jul. 21, 2016

Related U.S. Application Data

(63) Continuation of application No. PCT/AT2014/000181, filed on Oct. 2, 2014.

(30) Foreign Application Priority Data

Oct. 11, 2013 (AT) ..... A 785/2013

(51) Int. Cl.
*A47B 88/463* (2017.01)
*A47B 88/483* (2017.01)
(Continued)

(52) U.S. Cl.
CPC ..... *A47B 88/0481* (2013.01); *A47B 88/463* (2017.01); *A47B 88/47* (2017.01); *A47B 88/483* (2017.01); *A47B 2210/0083* (2013.01)

(58) Field of Classification Search
CPC . A47B 88/0477; A47B 88/0481; A47B 88/12; A47B 2210/0064;
(Continued)

(56) References Cited

U.S. PATENT DOCUMENTS 6,910,749 B2 * 6/2005 Mueller ..... A47B 88/0477 292/304
8,356,864 B2 * 1/2013 Koenig ..... E05B 17/0058 312/333
(Continued)

FOREIGN PATENT DOCUMENTS

AT 008 882 2/2007
AT 511964 A4 * 4/2013 ..... A47B 88/0481
(Continued)

OTHER PUBLICATIONS

DE202009013733 Translated Description.pdf, 12 pages.*
(Continued)

*Primary Examiner* — Andrew M Roersma
(74) *Attorney, Agent, or Firm* — Wenderoth, Lind & Ponack, L.L.P.

(57) ABSTRACT

An arrangement includes a first drive mechanism for moving a movable furniture part. The first drive mechanism has a lockable first push-out mechanism for pushing the movable furniture part out of a closed position into an open position, and a first locking mechanism for locking the first push-out mechanism in a locked position. The first push-out mechanism can be unlocked from the locked position by an overpressure movement of the movable furniture part into an overpressure position beyond the closed position. A synchronizing device synchronizes the first drive mechanism with a second drive mechanism, and can be moved by the first drive mechanism. The overpressure movement begins free of a movement transfer between the first drive mechanism and the synchronizing device. When the movable furniture part moves in the opening direction, the synchronizing device can be moved by the first drive mechanism.

28 Claims, 27 Drawing Sheets

(51) Int. Cl.
*A47B 88/47* (2017.01)
*A47B 88/04* (2006.01)

(58) Field of Classification Search
CPC ..... A47B 2210/0067; A47B 2210/007; A47B 2210/0078; A47B 2210/0083
See application file for complete search history.

(56) References Cited

U.S. PATENT DOCUMENTS

| | | | | |
|---|---|---|---|---|
| 8,474,925 | B2 * | 7/2013 | Koenig | A47B 88/0477 312/333 |
| 2003/0117048 | A1 | 6/2003 | Mueller | |
| 2005/0268432 | A1 * | 12/2005 | Migli | E05C 19/022 16/258 |
| 2007/0103043 | A1 | 5/2007 | Kropf et al. | |
| 2010/0314981 | A1 | 12/2010 | Koenig et al. | |
| 2010/0320888 | A1 | 12/2010 | Koenig et al. | |
| 2010/0327719 | A1 | 12/2010 | Koenig et al. | |
| 2012/0038255 | A1 | 2/2012 | Netzer et al. | |
| 2014/0021841 | A1 * | 1/2014 | Brunnmayr | A47B 88/16 312/319.1 |
| 2014/0060991 | A1 * | 3/2014 | Bohle | A47B 88/04 192/56.1 |
| 2014/0210329 | A1 | 7/2014 | Brunnmayr | |
| 2015/0374123 | A1 | 12/2015 | Goetz et al. | |

FOREIGN PATENT DOCUMENTS

| | | | | |
|---|---|---|---|---|
| AT | 514065 | | 10/2014 | |
| CN | 201609215 | | 10/2010 | |
| CN | 101951808 | | 1/2011 | |
| CN | 101977533 | | 2/2011 | |
| CN | 101977534 | | 2/2011 | |
| CN | 201987013 | | 9/2011 | |
| CN | 202112640 | | 1/2012 | |
| CN | 202262655 | | 6/2012 | |
| DE | 101 25 324 | | 3/2002 | |
| DE | 10125324 | A1 * | 3/2002 | A47B 88/40 |
| DE | 202009013733 | U1 * | 3/2011 | A47B 88/463 |
| DE | 20 2009 013 733 | | 5/2011 | |
| DE | 20 2009 005 255 | | 6/2011 | |
| EP | 1 314 842 | | 5/2003 | |
| EP | 1 598 509 | | 11/2005 | |
| EP | 2 322 745 | | 5/2011 | |
| EP | 2 429 339 | | 3/2012 | |
| JP | 2012-531991 | | 12/2012 | |
| WO | 2009/114884 | | 9/2009 | |
| WO | 2009/114886 | | 9/2009 | |
| WO | 2009/114887 | | 9/2009 | |
| WO | 2011/003738 | | 1/2011 | |
| WO | WO2012146516 | A1 * | 10/2012 | A47B 88/04 |
| WO | 2013/059847 | | 5/2013 | |
| WO | WO2013096981 | A1 * | 7/2013 | A47B 88/04 |

OTHER PUBLICATIONS

WO2011003738 Translated Description, 14 pages.*
International Search Report dated Apr. 9, 2015 in corresponding International Application No. PCT/AT2014/000181 (with English translation).

* cited by examiner

VS

SS

VS

SS

ÜS

OS

SS

VS

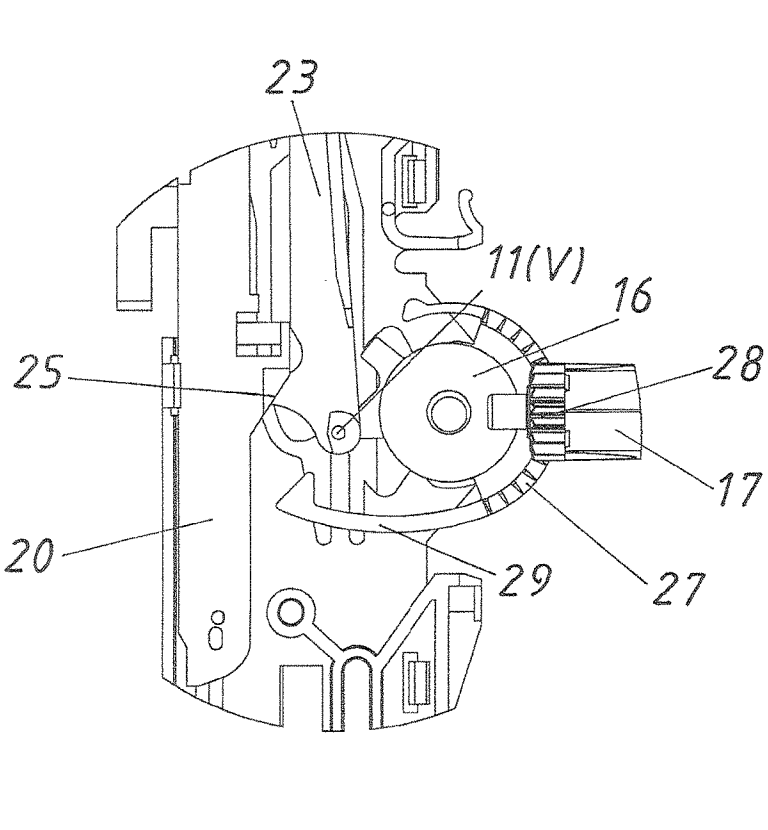
Fig. 20
SS
VS
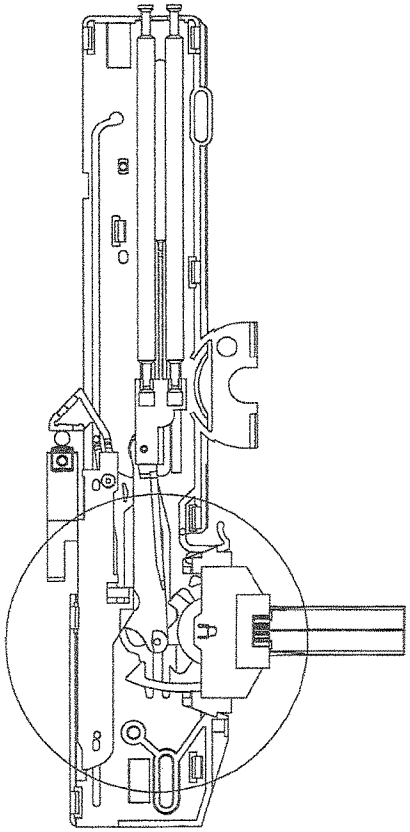

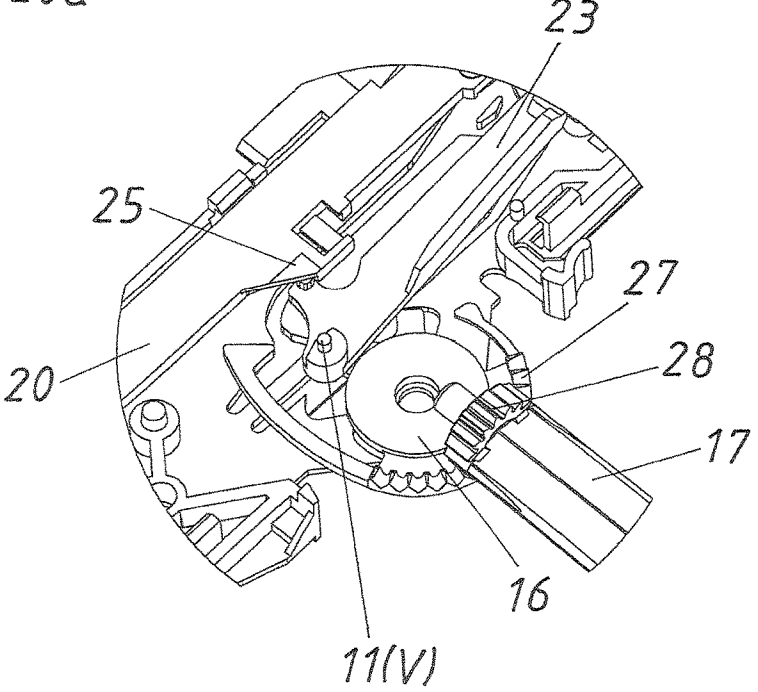
Fig 20a
SS
VS
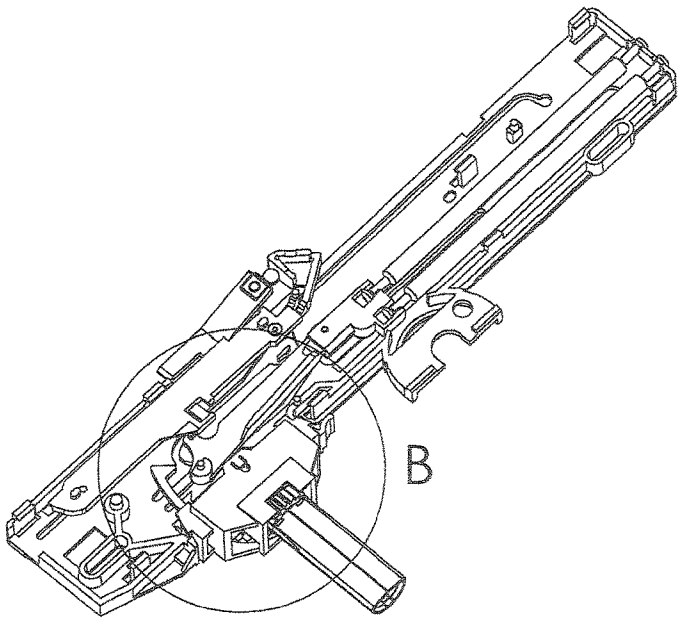

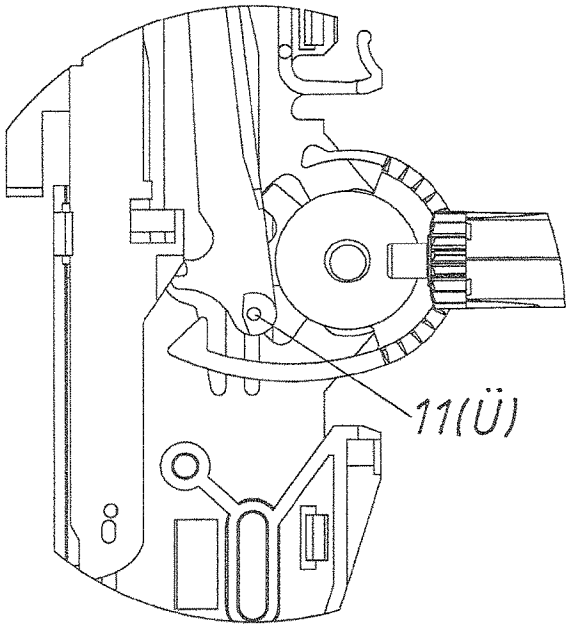
Fig.21
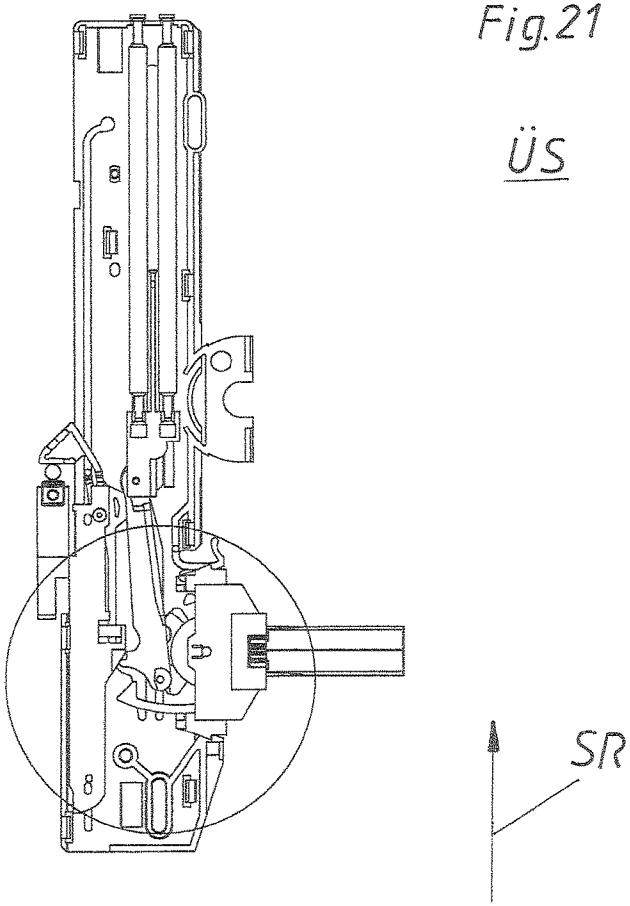

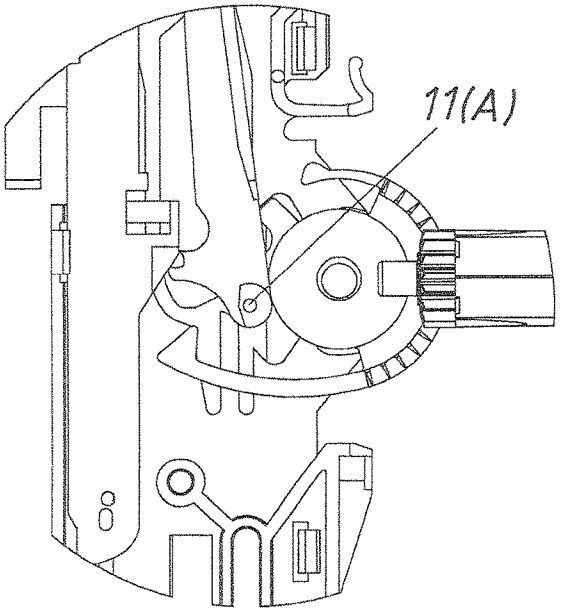
Fig. 22
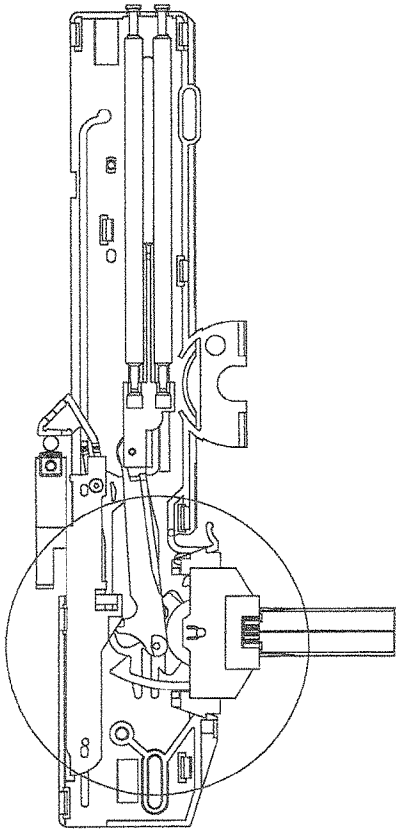

DRIVE MECHANISM FOR MOVING A MOVABLE FURNITURE PART

BACKGROUND OF THE INVENTION

The invention concerns an arrangement comprising a first drive device for moving a moveable furniture part, wherein the first drive device has a lockable first ejection device for ejection of the moveable furniture part from a closed position into an open position and a first locking device for locking the first ejection device in a locking position. The first ejection device can be unlocked from the locking position by an overpressing movement of the moveable furniture part into an overpressing position which is beyond the closed position. The arrangement further includes a synchronizing device for synchronizing the first drive device with a second drive device, and the synchronizing device is moveable by the first drive device. In addition, the invention concerns an article of furniture comprising such an arrangement.

Drive devices—so-called touch-latch mechanisms—for moving or ejecting moveable furniture parts (drawers, furniture doors, flaps and so forth) have already been known for many years in the furniture fitment industry. With those devices, the opening movement is performed automatically, and a user only has to apply pressure to the moveable furniture part to activate the ejection mechanism.

Especially when dealing with wide drawers, two drive devices are often provided at mutually opposite side regions of the drawer or the furniture carcass in order to reliably detect pressure being applied to the drawer at any location. If now however only one of those two drive devices is triggered by that pressure applied to the drawer, problems can arise like inclined positioning of the drawer or jamming or wedging.

To resolve those problems, various methods involving synchronizing devices for synchronizing the two drive devices are already known from the state of the art. By virtue thereof, movements of the two mutually spaced drive devices are coordinated, in other words synchronized. That is intended to guarantee a set of movements which is of the same kind at both sides.

Examples of such drive or ejection devices with synchronization are to be found in EP 2 429 339 B1, WO 2009/114884 A1, EP 1 314 842 B1 and AT 008 882 U1. With those devices, the entire unlocking operation and also a part of the ejection operation are synchronized. Particularly in the overpressing movement, that has the disadvantage that pressure always has to be applied against the ejection force storage means of both ejection devices, thereby giving an impression of relatively stiff and sluggish unlocking. Another disadvantage is that a relatively large front panel gap is necessary to provide for unlocking at both sides by virtue of the large clearance between the many components.

Another example of synchronization is disclosed in WO 2013/059847 A1, which in particular involves locking—and not unlocking—occurring synchronously on both sides in order to guarantee reliable and trouble-free closure.

In addition, attention is also to be directed to DE 20 2009 005 255 U1 which, unlike the above-listed specifications, does not have an independent component of the ejection device, as a synchronization element. Rather, in this case the drawer itself so-to-speak forms a synchronization element as the force of a latching fitment which has just been unlocked is transmitted by way of the drawer to the other latching fitment whereby the force of both ejection force storage means provides for unlocking of the other latching fitment.

A disadvantage here is that really high forces are acting in particular in the operation of unlocking the other latching fitment. In addition, by virtue of synchronization by way of the drawer itself, the structure involves a large clearance whereby a severely inclined position can already be involved in unlocking the other latching fitment. In addition, the triggering travel in particular for the other latching fitment is long.

SUMMARY OF THE INVENTION

The object of the present invention is therefore to provide an arrangement which is improved over the state of the art. In particular the invention seeks to provide that unlocking is to be smoothly and freely possible, there can be a small clearance, and the triggering travel can be short.

That object is achieved by an arrangement having the features described below. Accordingly, it is provided in accordance with the invention that the overpressing movement begins free from a movement transmission between the first drive device and the synchronizing device, and the synchronizing device is moveable upon a movement of the moveable furniture part in the opening direction by the first drive device. In other words, the overpressing movement begins without transmission of movement from the first drive device to the synchronizing device. Stated once again in other words, a transmission of movement from the drive device to the synchronizing device takes place only after unlocking.

Therefore, in performing unlocking, there is no need to press against both force storage members. By virtue of the fact that in the unlocking process—in contrast to the above-mentioned state of the art—there is no transmission of movement to the synchronizing device of whatever design configuration that may be, the tolerances in the region of the synchronizing device do not play any part and the triggering travel can remain short. As a result, the panel gap between the drawer front panel and the furniture carcass can also remain small. Accordingly, in accordance with a preferred embodiment, it is provided that the panel gap is at a maximum 3 mm, particularly preferably at a maximum 2.5 mm. Ideally the panel gap is at a maximum 2 mm.

In principle, it is also possible for a transmission of movement to the synchronizing device to already occur shortly after unlocking—therefore still during the overpressing movement. Preferably, however, it is provided that the synchronizing device is moveable by the first drive device only upon a movement of the moveable furniture part in the opening direction. More specifically, the beginning of the ejection movement in the overpressing position can also be free from a movement transmission to the synchronizing device. It is only as soon as the ejection device of the drive device has again reached the position corresponding to the closed position, in the opening direction, that the transmission of movement to the synchronizing device begins.

Further, preferably the synchronizing device is provided separately from the moveable furniture part. In other words, movements of the first drive device can be transmitted by way of the synchronizing device independently of the moveable furniture part.

The apparatus can include only a drive device and the synchronizing device are embraced by the protection thereof. That is to be attributed to the fact that the advantages according to the invention can already be described by those two components alone. Preferably, however, the arrangement also has a lockable second drive device for moving the moveable furniture part. For that purpose it can particularly preferably be provided that the second drive device is of a mirror-image symmetrical configuration relative to the first drive device. By virtue of that second drive device it is also possible that, in the overpressing movement, by only one drive device by virtue of the movement of the ejection device of that drive device in the opening direction and by virtue of the movement transmission by means of the synchronizing device to the other drive device, the ejection device of the other drive device is unlockable from the locking position. In other words, preferably, in the movement triggered by the first drive device of the moveable furniture part from the overpressing position in the opening direction, the second drive device is unlockable by the synchronizing device which is moved by the first drive device.

The preferred embodiments by way of example which are described in greater detail hereinafter are always to be read in relation to both drive devices although the actual specific description is only ever set out on the basis of the first drive device and its components. Accordingly, all items of description also correspondingly apply to the second drive device.

In actual terms in a preferred embodiment by way of example of the present invention, the first ejection device has a housing, an ejection slider displaceable on the housing, an ejection force storage device acting on the ejection slider, and a control lever mounted moveably, preferably rotatably, to the ejection slider. The first locking device has a latching element arranged on the control lever and a locking element against which the latching element bears in the locking position.

Further preferably, the latching element is moveable in the overpressing movement from the locking position into an overpressing portion and is moveable in the opening movement by the ejection force storage means through an ejection portion, and the locking element is moveable by the latching element which is moved in the ejection portion in the opening direction. In other words, when the latching element is no longer in the locking position, the latching element can move the locking element.

In principle, locking can be effected by way of per se known touch latch mechanisms. Preferably, however, the first drive device has a cardioidal sliding track for the latching element, with a stressing portion provided in the housing for stressing the ejection force storage means, a locking portion, in which the locking element also forms the locking portion, the overpressing portion in the housing, and the ejection portion in the housing.

Further preferably, the locking element is connected to the synchronizing device. A particularly simple arrangement with few components is afforded if the locking element is formed in one piece with the synchronizing device or with at least a part of the synchronizing device. Here, the locking element can be mounted moveably, preferably rotatably, to the housing.

The particular advantages of the simple structure are enjoyed in particular when the locking element has a locking surface against which the latching element bears in the locking position, and a synchronizing surface against which the latching element bears in the movement through the ejection portion in the opening direction. In that case, the locking surface is oriented substantially tangentially relative to the direction of rotation of the locking element and the synchronizing surface is oriented substantially radially in relation to the axis of rotation of the locking element. In other words, no rotation of the locking element—and thus no synchronization—can be triggered by exerting force on the locking surface. It is only by exerting force on the synchronizing surface that the rotary movement and thus the synchronizing movement can take place.

Preferably, the synchronizing device has a coupling element for connecting the synchronizing device to the first drive device and a synchronizing bar which is connected preferably hingedly to the coupling element. Preferably, the locking element is part of the coupling element. Particularly preferably, the locking element is in one piece with the coupling element of the synchronizing device.

The drive device, however, can have not just an ejection device but also a retraction device for retracting the moveable furniture part from an open position into the closed position. That retraction movement can also be damped by a damper.

In accordance with the foregoing description, unlocking is effected by overpressing of the moveable furniture part into an overpressing position which is beyond the closed position. Opening by pulling, however, is also possible. In that case, however, no unlocking is effected—like for example in DE 20 2009 005 255 U1—but the moveable furniture part can be simply moved in the opening direction without releasing the locking action. By way of example in that respect, attention is directed to the Austrian patent application which is not a prior publication, bearing the application filing number A 296/2013.

Protection is also claimed for an article of furniture comprising a furniture carcass, a furniture part moveable on the furniture carcass, preferably by way of an extension guide, and an arrangement according to the invention. In principle, in that case the drive device can be fixed to the furniture carcass and can engage an entrainment member arranged on the moveable furniture part. Preferably, however, the housing of the drive device—like also the synchronizing device—is arranged on the moveable furniture part, preferably at the underside of a drawer, and engages an entrainment member which is fixed with respect to the furniture carcass. In either case, an attachment element of the drive device—in the form of the entrainment member or the housing—is always arranged or mounted on the moveable furniture part so as to therefore necessarily move with the moveable furniture part.

BRIEF DESCRIPTION OF THE DRAWINGS

Further details and advantages of the present invention are described more fully hereinafter by means of the specific description with reference to the embodiments by way of example illustrated in the drawings in which:

FIGS. 20 through 23*a* are plan views and perspective views of the movements of the arrangement shown in FIG. 19.

DETAILED DESCRIPTION OF THE INVENTION

Figure 1:
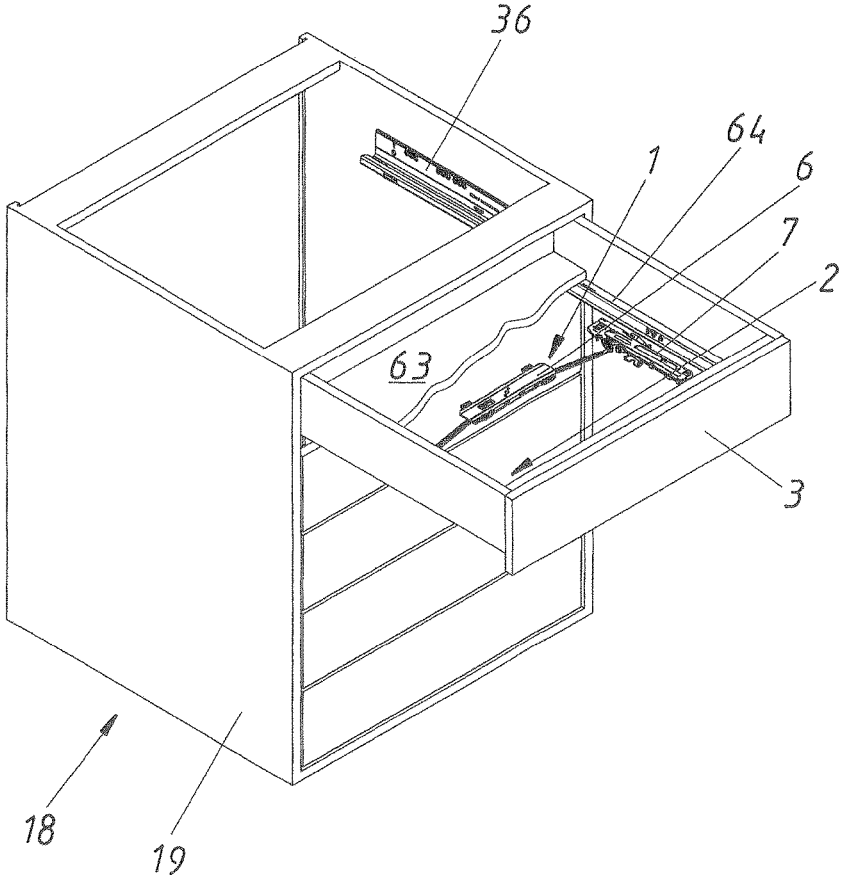
FIG. 1 is a partly broken-away perspective view of an article of furniture having a moveable furniture part together with drive devices and a synchronizing device.

FIG. 1 shows an article of furniture 18 comprising a furniture carcass 19 and a furniture part 3 which is moveable relative thereto in the form of a drawer, as a partly broken-away perspective view. The drawer is mounted moveably to the furniture carcass 19 by an extension guide 36. Mounted at the underside of the moveable furniture part 3 is an arrangement 1 which has two drive devices 2 (FIG. 5) and 7 which are fixed laterally to the drawer bottom 63 and to a drawer rail 64 respectively, and a synchronizing device 6.

Figure 2:
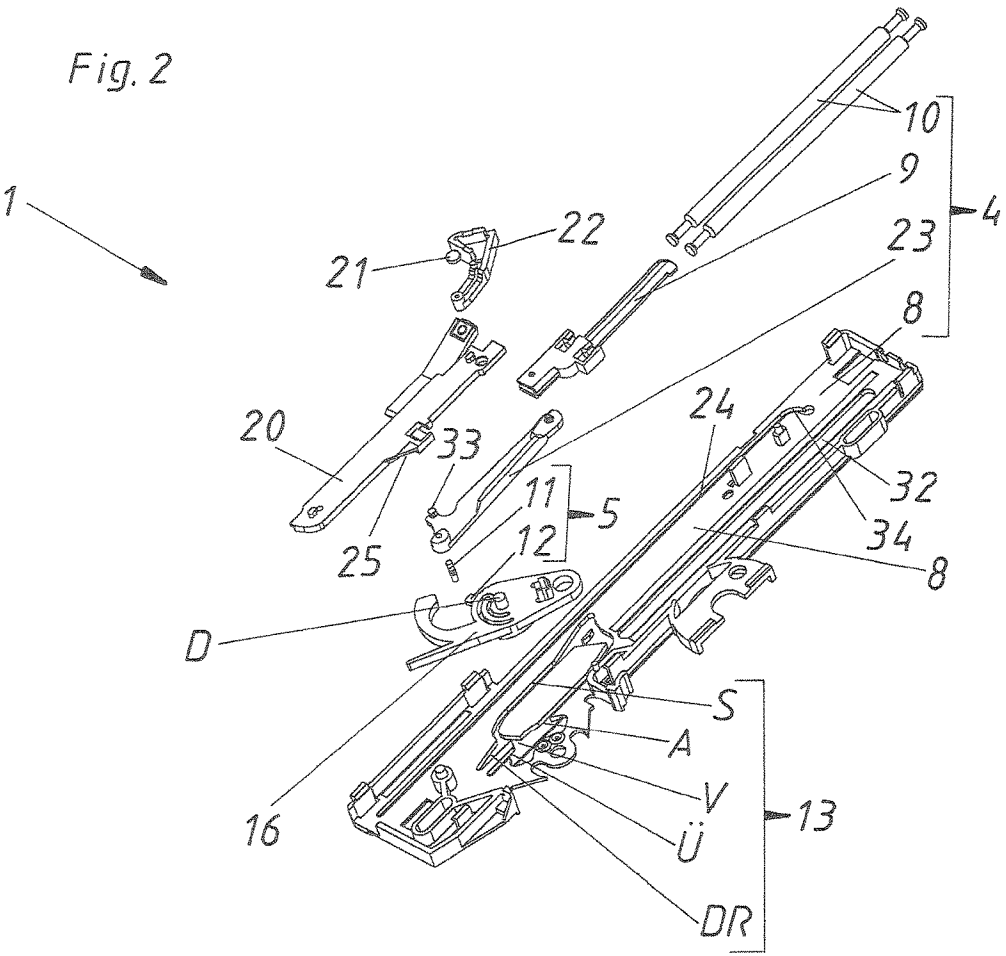
FIG. 2 is an exploded view of a drive device.

FIG. 2 shows an exploded view of the essential components of the arrangement 1 together with the first drive device 2. The first drive device 2 is mounted to the moveable furniture part 3 by way of the housing 8. Thus, in this embodiment, the housing 8 serves as an attachment element which is to always be mounted to the moveable furniture part 3 so as to necessarily move with the moveable furniture part 3 into an overpressing position ÜS, a closed position SS, and an open position OS of the moveable furniture part 3, as applicable. As noted above, however, it is also possible for an entrainment member 21 (described below) to serve as the attachment element which is to always be mounted or fixed to the moveable furniture part 3 so as to necessarily move with the moveable furniture part 3 into the overpressing position ÜS, the closed position SS, and the open position OS of the moveable furniture part 3, as applicable.

The ejection force storage devices 10 which are in the form of tension springs are held on the one hand to the housing 8 and on the other hand to the ejection slider 9. The ejection slider 9 is displaceable along the guide track 32 in the housing 8. The housing 8, the ejection force storage devices 10, the ejection slider 9 and the control lever 23 together form the essential components of the first ejection device 4. In addition, however, the transmission element 20 can also be associated with the first ejection device 4. The transmission element 20 bears by way of the transmission abutment 25 against the abutment 33 on the control lever 23. The transmission element 20 is displaceable along the control track 24 in the housing 8. That control track 24 has an angled end portion 34. As soon as the catch lever 22 hingedly connected to the transmission element 20 passes into that angled end portion 34, the catch lever 22 pivots whereby the drive device 2 is released from the entrainment member 21 which is fixed with respect to the furniture carcass. When conversely the catch lever 22 leaves that angled end portion 34 the entrainment member 21 is caught or held between the catch lever 22 and the transmission element 20. In addition, the coupling element 16 of the synchronizing device 6 is mounted rotatably about the axis of rotation D on the housing 8. Also provided in one piece with that coupling element 16 is the locking element 12 which jointly with the latching element 11 disposed on the control lever 23 forms the locking device 5 for the first ejection device 4. In addition, the Figure shows the cardioidal sliding track 13 which is provided in the housing 8 and which has the stressing portion S, the pressing-through portion DR, the locking portion V, the overpressing portion Ü and the ejection portion A. The locking portion V is additionally also formed by the locking element 12.

Figure 3:
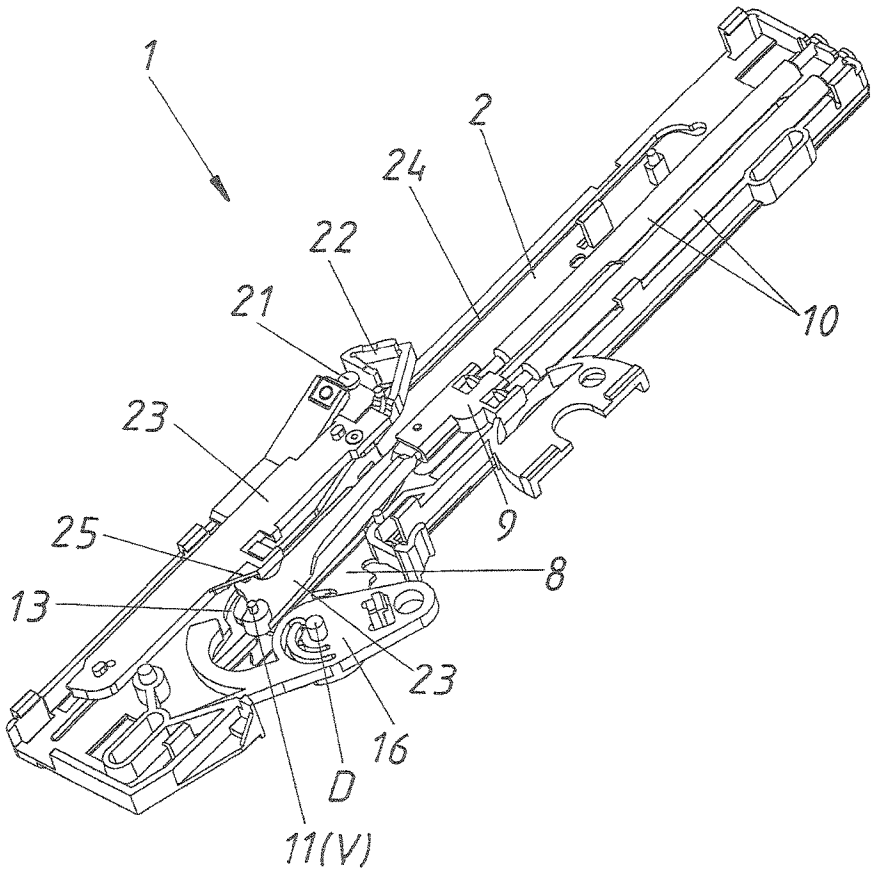
FIG. 3 is a perspective view of the assembled drive device.

FIG. 3 shows the arrangement 1 in the assembled condition. The ejection force storages devices 10 are stressed and the latching element 11 is disposed in the locking portion V whereby the first ejection device 4 is in the locking position VS. As the entrainment member 21 is caught by the catch lever 22 the moveable furniture part 3 is in the closed position SS.

Figure 4:
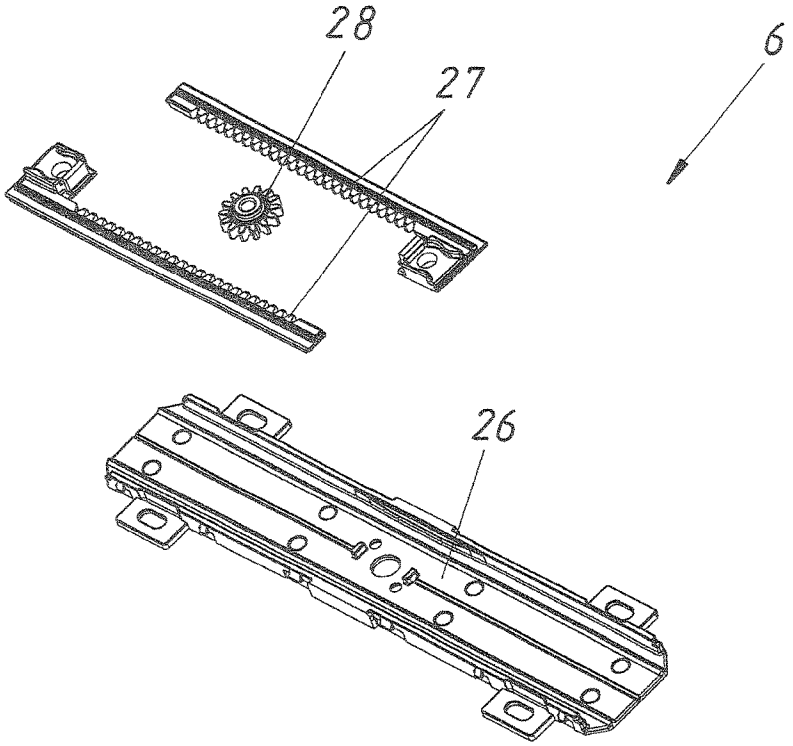
FIG. 4 is parts of a synchronizing device.

An example of components of a synchronizing device 6 is shown in FIG. 4. In this case, the toothed racks 27 and the toothed gear 28 are mounted moveably to the base plate 26.

Figure 5:
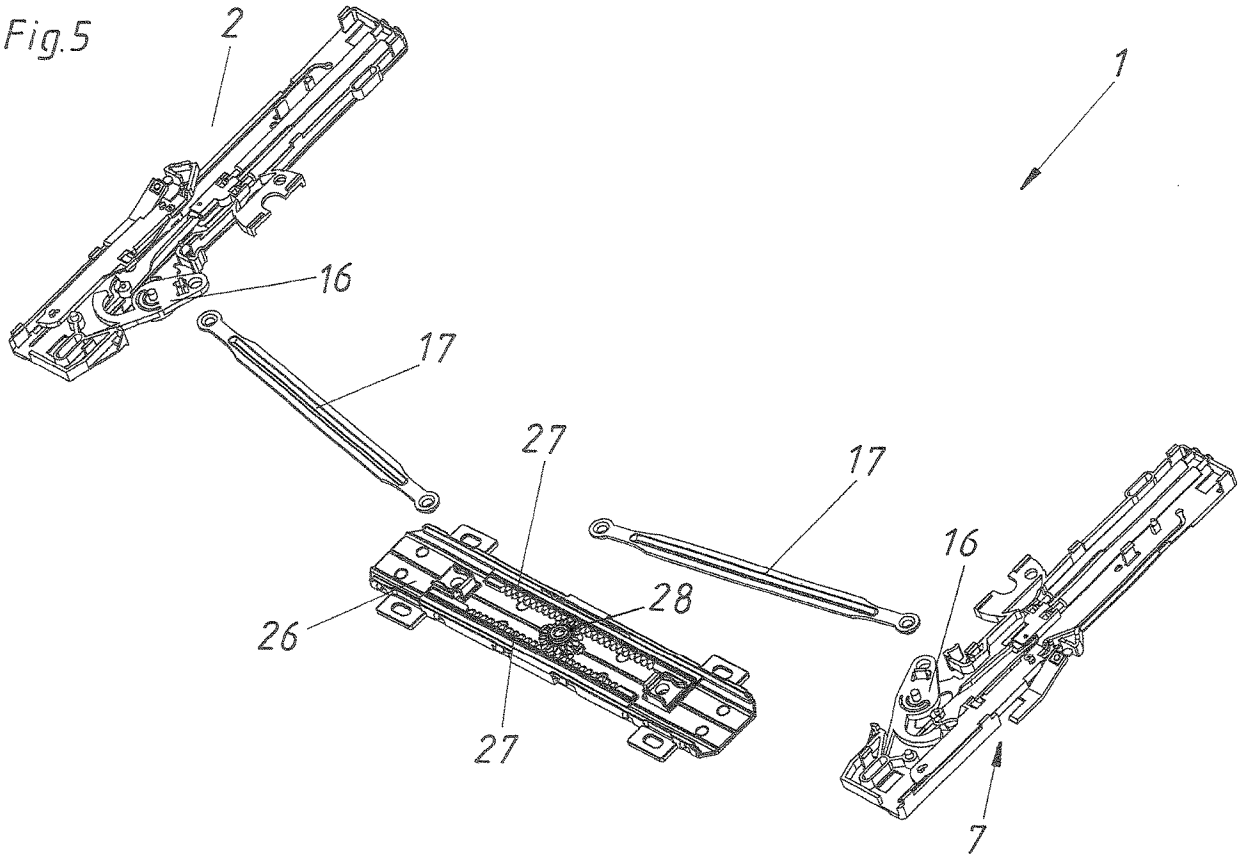
FIG. 5 is a partly exploded view of the arrangement with two drive devices and the synchronizing device.

FIG. 5 shows the individual components of the arrangement 1 in a condition of not yet being entirely assembled as the connection by way of the synchronizing bars 17 has not yet been made.

Figure 6:
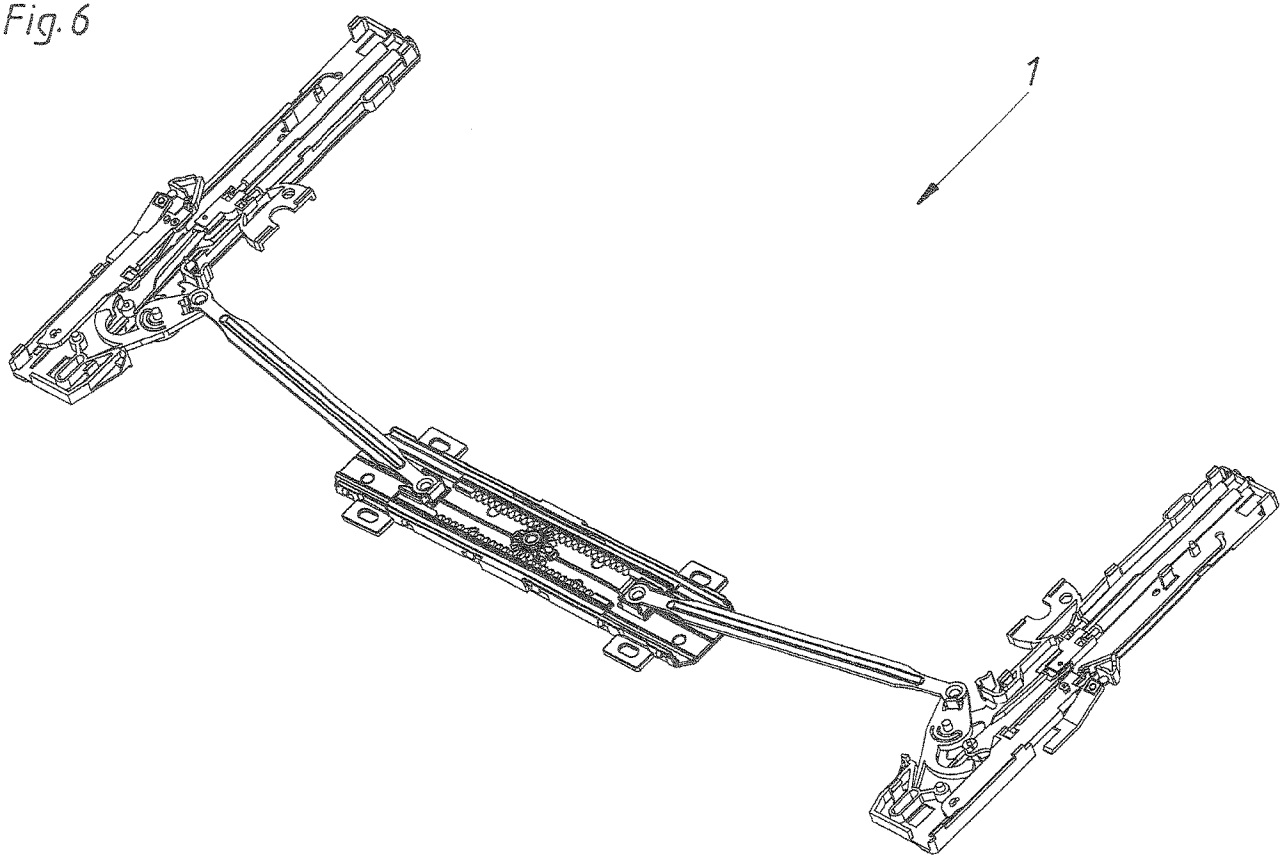
FIG. 6 shows the assembled arrangement.

This however is shown in FIG. 6 whereby the synchronizing bars 17 are respectively rotationally hingedly connected on the one hand to the coupling elements 16 and on the other hand to the racks 27.

Figure 7:
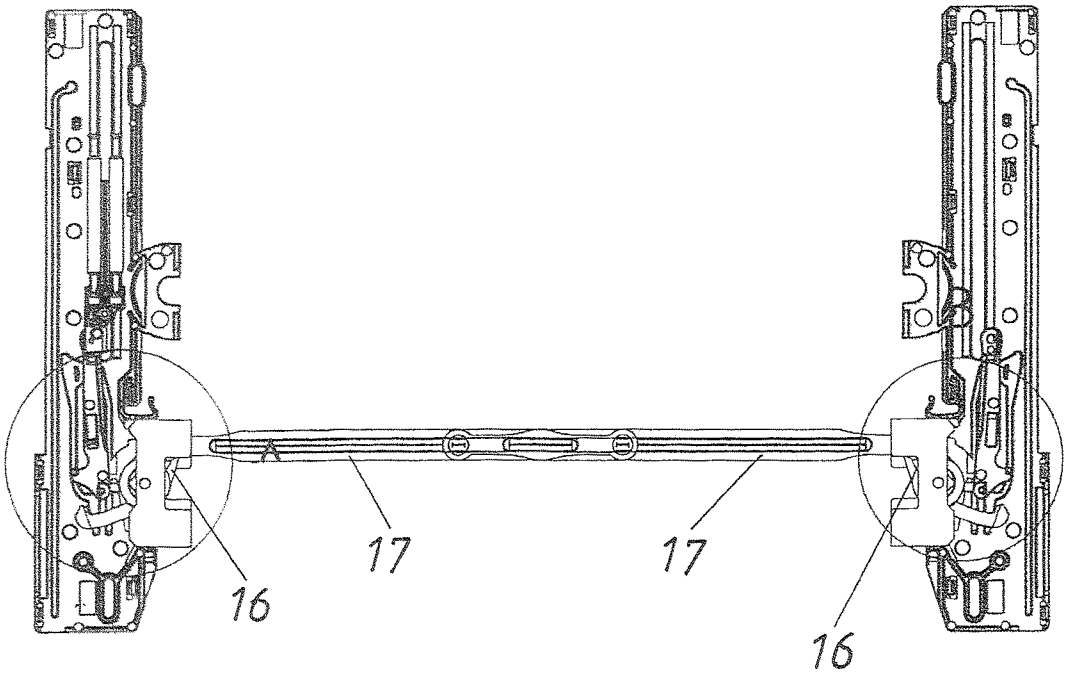
FIG. 7 shows an alternative variant of the synchronizing device.

FIG. 7 shows a configuration of the synchronizing device 6, which is an alternative to FIG. 6, wherein the synchronizing bars 17 are positively guided linearly against each other by way of slot connections.

Figure 8:
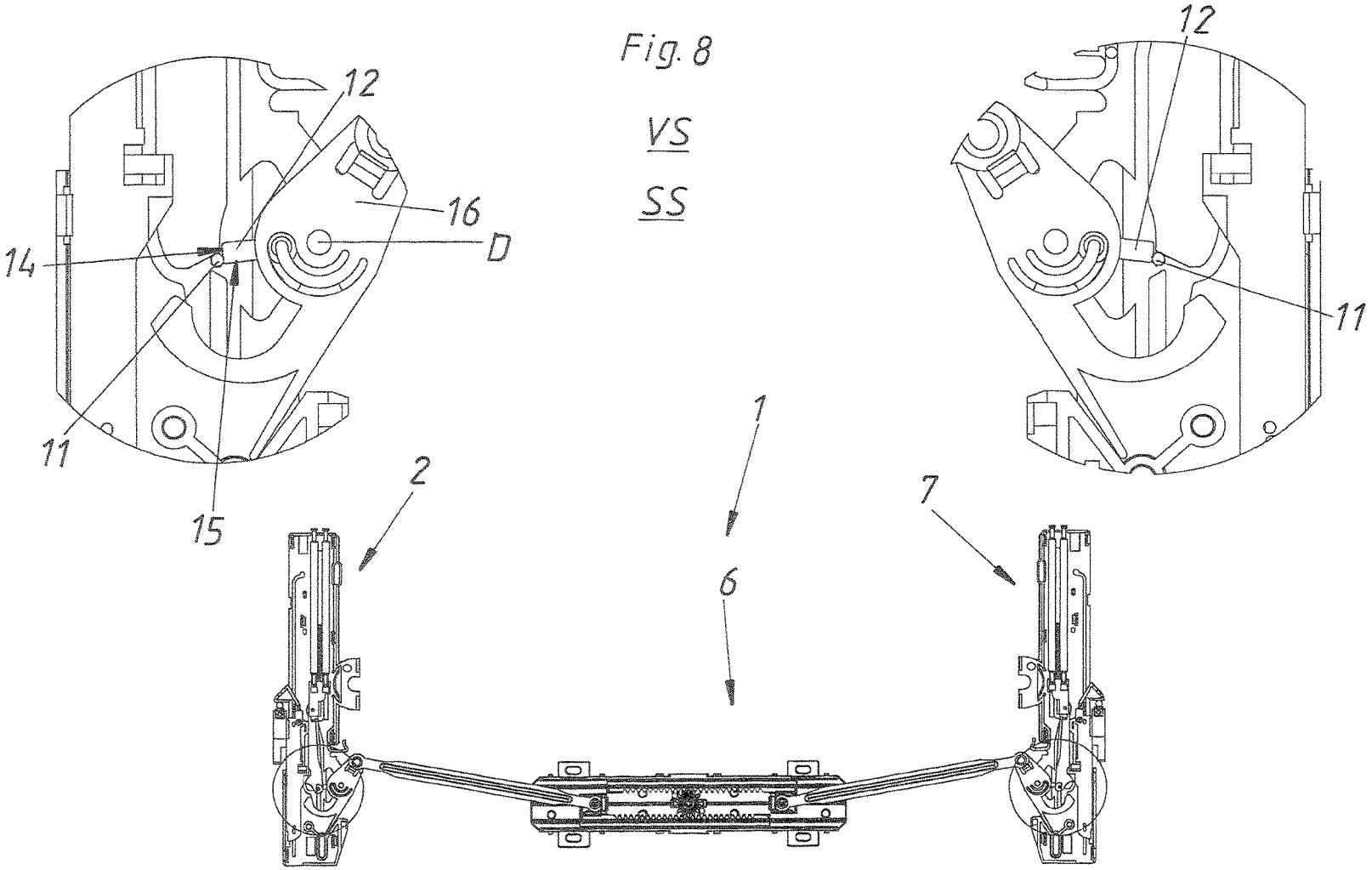
FIGS. 8 through 18 are plan views of the movements of an arrangement.

FIG. 8 now shows a plan view of the arrangement 1 with the first drive device 2, the second drive device 7 and the synchronizing device 6. It is possible to see from the detail portions shown at left and right that in each case, the latching element 11 is in the locking portion V of the cardioidal sliding track 13. In this situation, the latching element 11 bears against the locking surface 14 of the locking element 12. That locking surface 14 is oriented tangentially relative to the direction of rotation of the axis of rotation D and adjacent 6 to synchronizing surface 15. As therefore the force of the ejection force storage devices 10, that is acting on the latching element 11, cannot trigger a rotary movement of the coupling element 16, the ejection devices 4 respectively remain in their locking position VS. The moveable furniture part 3 is disposed in the closed position.

Figure 9:
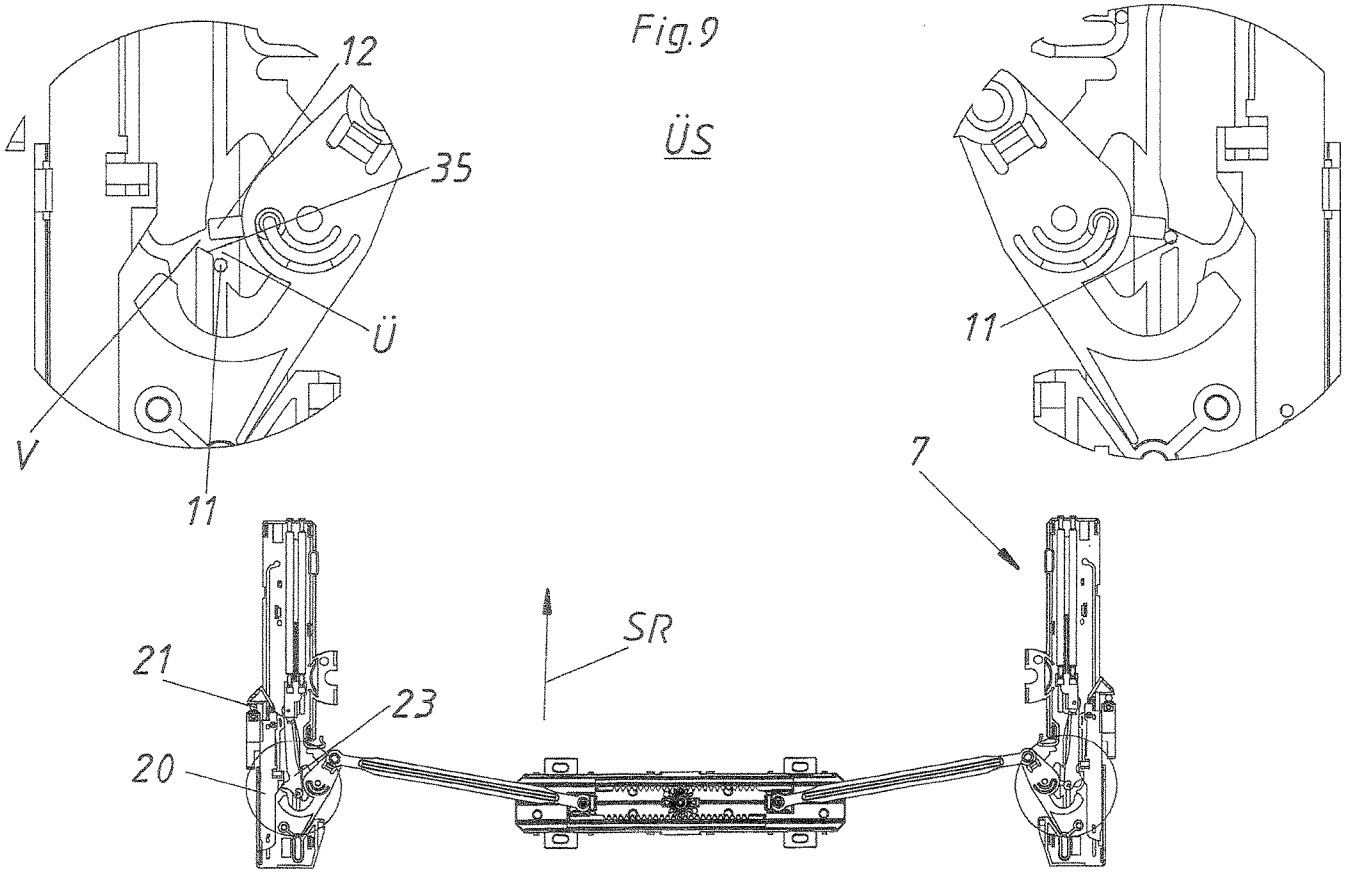

If now starting from FIG. 8 a pressure is applied at one side in the closing direction SR to the left-hand region of the moveable furniture part 3, the latching element 11 of the first drive device 2 is moved into the overpressing portion Ü as the housing 8 moves in the closing direction relative to the control lever 23, the transmission element 20 and the entrainment member 21 (see FIG. 9). In that case, the latching element 11 is moved by the inclined deflection portion 35 from the locking portion V into the overpressing portion Ü. That overpressing movement begins free from a movement transmission between the first drive device 2 and the synchronizing device 6 (e.g., no movement is transmitted from the first drive device 2 to the synchronizing bars 17 of the synchronizing device 6). The second drive device 7 thus remains uninfluenced by that overpressing movement on the left-hand side. As a result, the overpressing movement is only performed against the force of the ejection force storage device 10 of an ejection device 4. The moveable furniture part is thus disposed—at least at one side—in the overpressing position ÜS.

Figure 10:
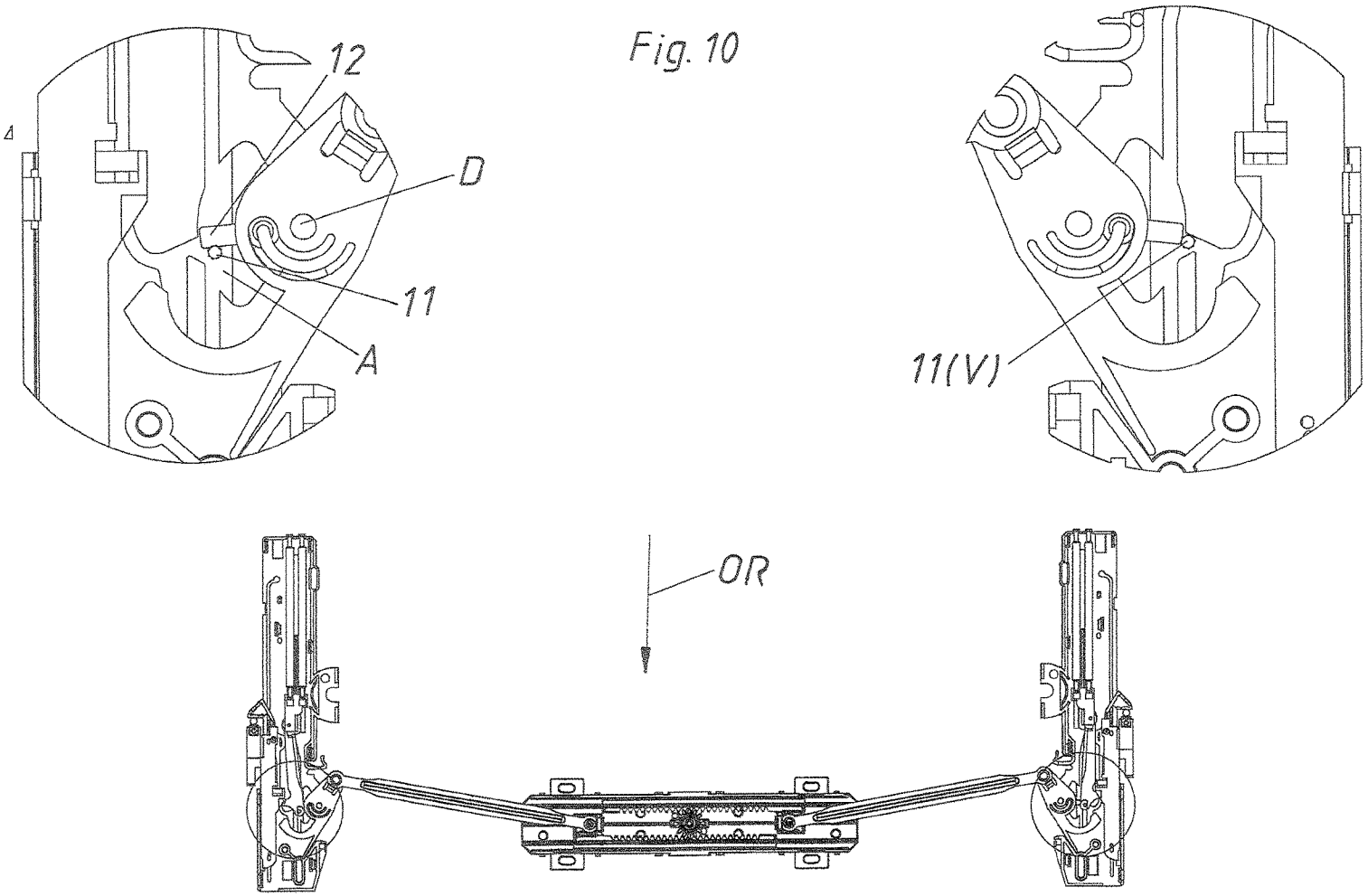

As soon as the moveable furniture part 3 is released, the ejection force storage devices 10 of the first ejection device 4 can be relieved of stress. As a result, the housing 8 together with the moveable furniture part 3 fixed thereto is ejected relative to the entrainment member 21 in the opening direction OR (see FIG. 10) whereby the latching element 11 also passes into the ejection portion A of the cardioidal sliding track 13. The first ejection device 4 therefore actually thrusts against the furniture carcass 19, more specifically the entrainment member 21. Up until then there has not been any transmission of movement to the synchronizing device 6. As shown in FIG. 10, however, the latching element 11 already bears against the synchronizing surface 15 (see FIG. 8) of the locking element 12. That synchronizing surface 15 is oriented radially relative to the axis of rotation D of the coupling element 16.

Figure 11:
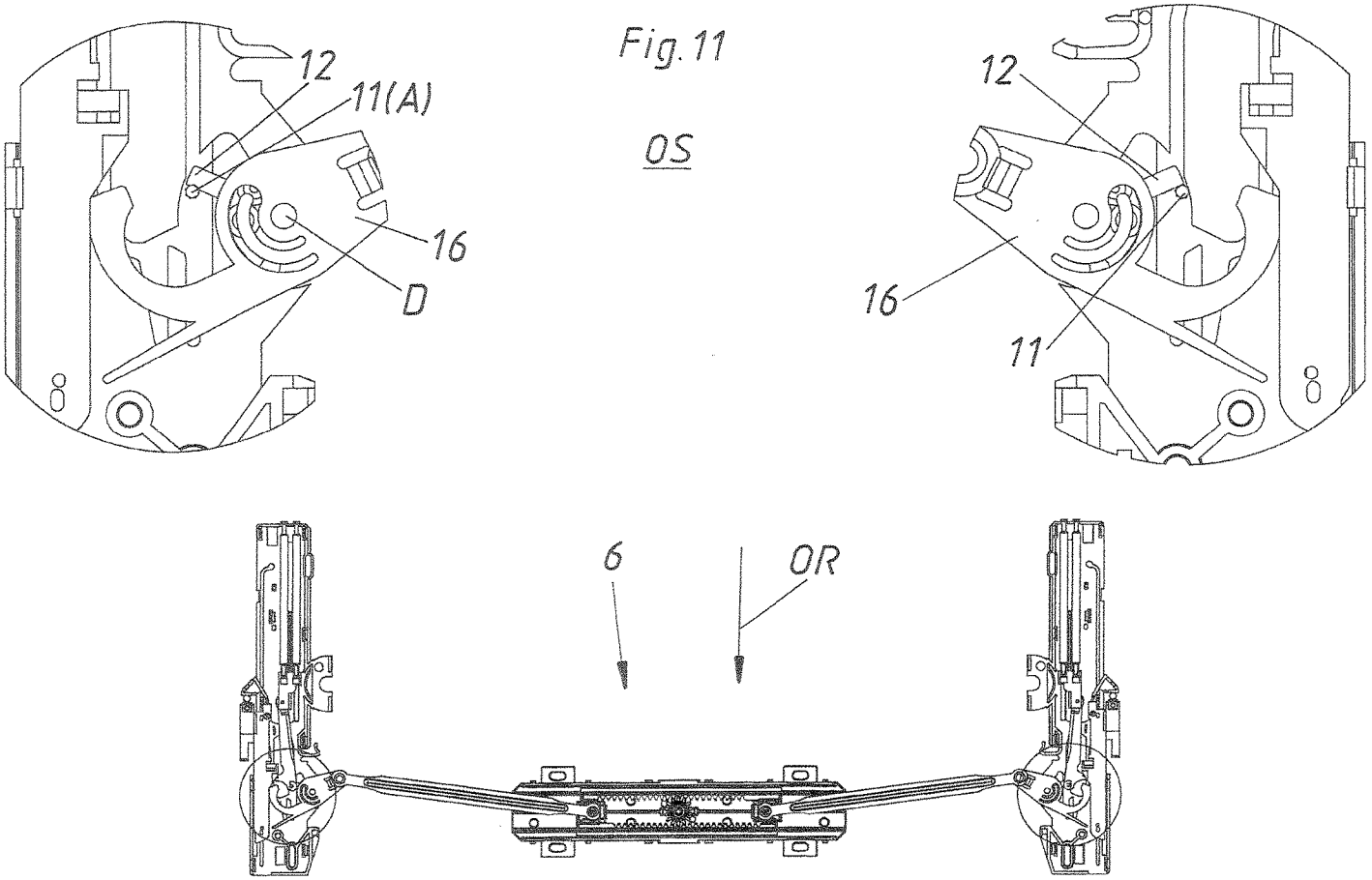

By virtue of that orientation of the synchronizing surface 15, finally—when the ejection force storage device 10 moves the latching element 11 further through the ejection portion A in the opening direction into the position shown in FIG. 11—the transmission of movement from the first drive device 2 to the synchronizing device 6 and further to the second drive device 7 takes place. By virtue of the synchronizing effect, the locking element 12 of the second drive device 7 is pivoted whereby the latching element 11 is no longer locked at the locking surface 14 thereof. Thus, that latching element 11 passes directly from the locking portion V into the ejection portion A. Therefore the ejection force storage device 10 of the second ejection device 4 can also be relieved of stress and the moveable furniture part 3 is ejected synchronously into an open position OS by both ejection devices 4.

Figure 12:
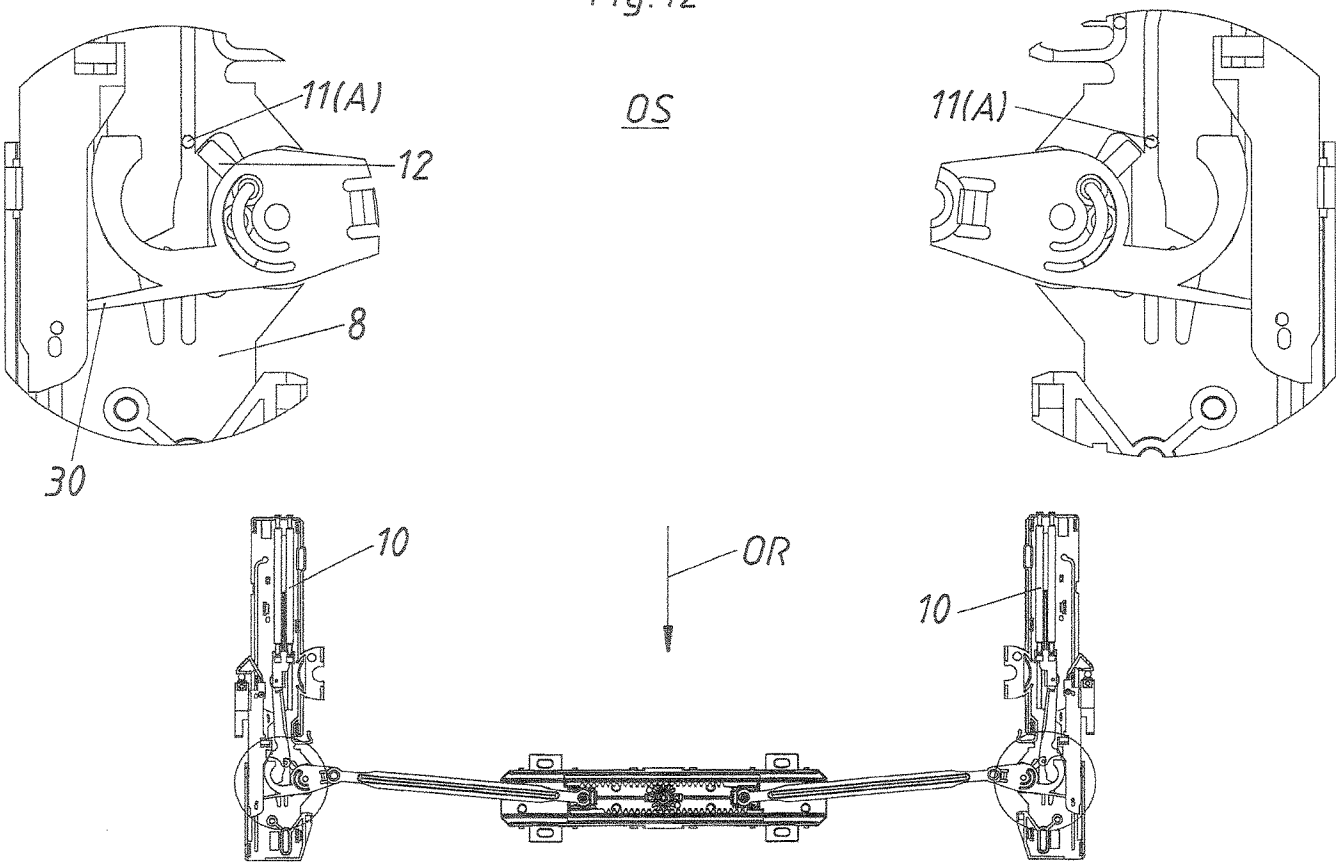

After further rotation of the two coupling elements 16 into the position shown in FIG. 12, the latching element 11 and the locking element 12 no longer bear against each other. The ejection force storage devices 10 of both ejection devices 4 can be further relieved of stress. In comparison with FIG. 10, it is also possible to clearly see that the coupling element 16 has rotated through about 50° about the axis of rotation D. Preferably that rotary movement is limited on the one hand by the locking element 12 coming into abutment against the housing 8 and on the other hand by the slightly elastic spring element 30 also coming into abutment against the housing 8. In general, depending on the respective design configuration, that rotary range can be between 30° and 90°. The relatively wide range of rotary movement gives the advantage that in particular the total clearance of the synchronizing device 6 has scarcely any influence on synchronization.

Figure 13:
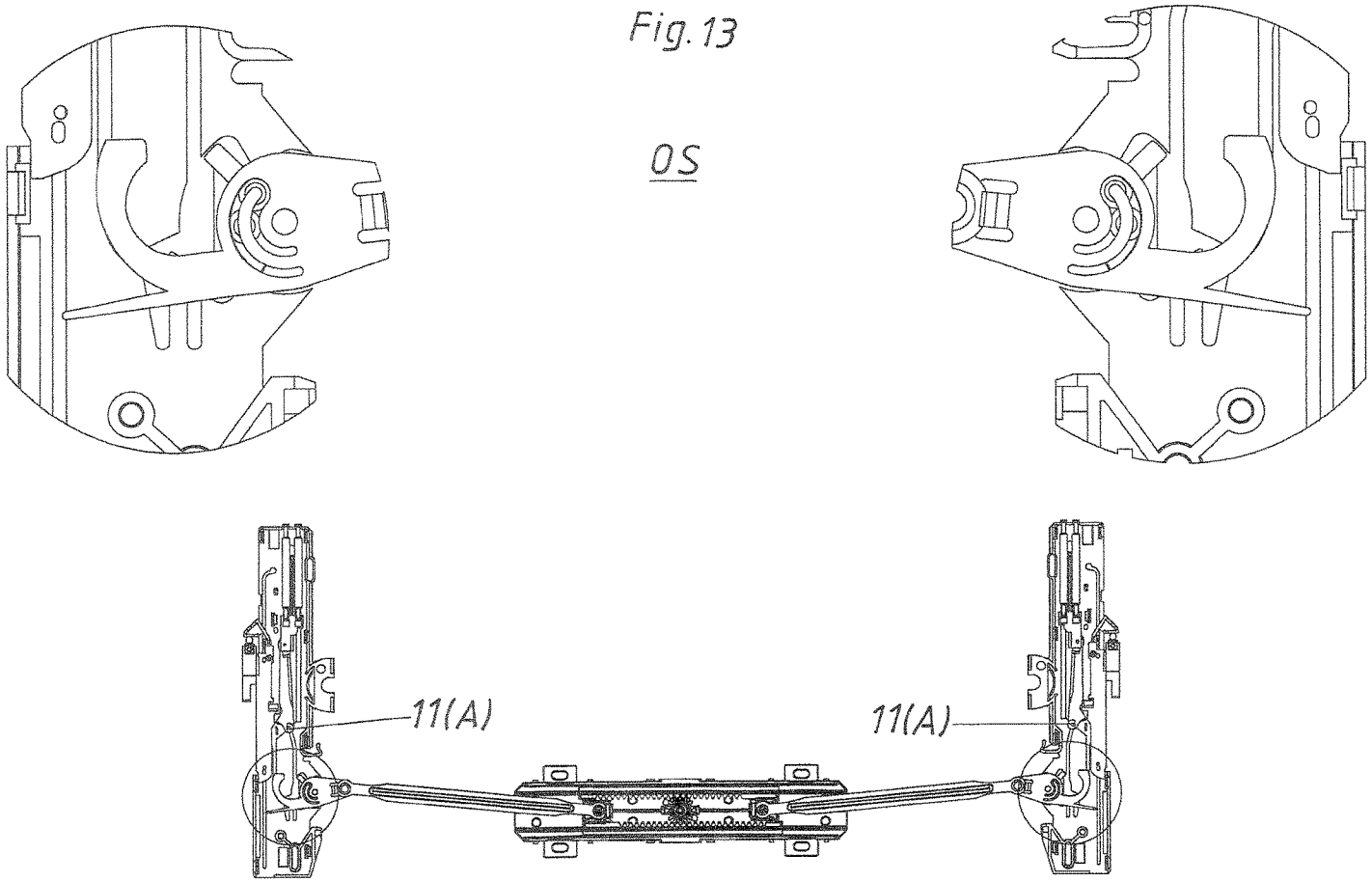

Finally, as shown in FIG. 13, both ejection force storage devices 10 are fully relieved of stress and the ejection operation is concluded.

Figure 14:
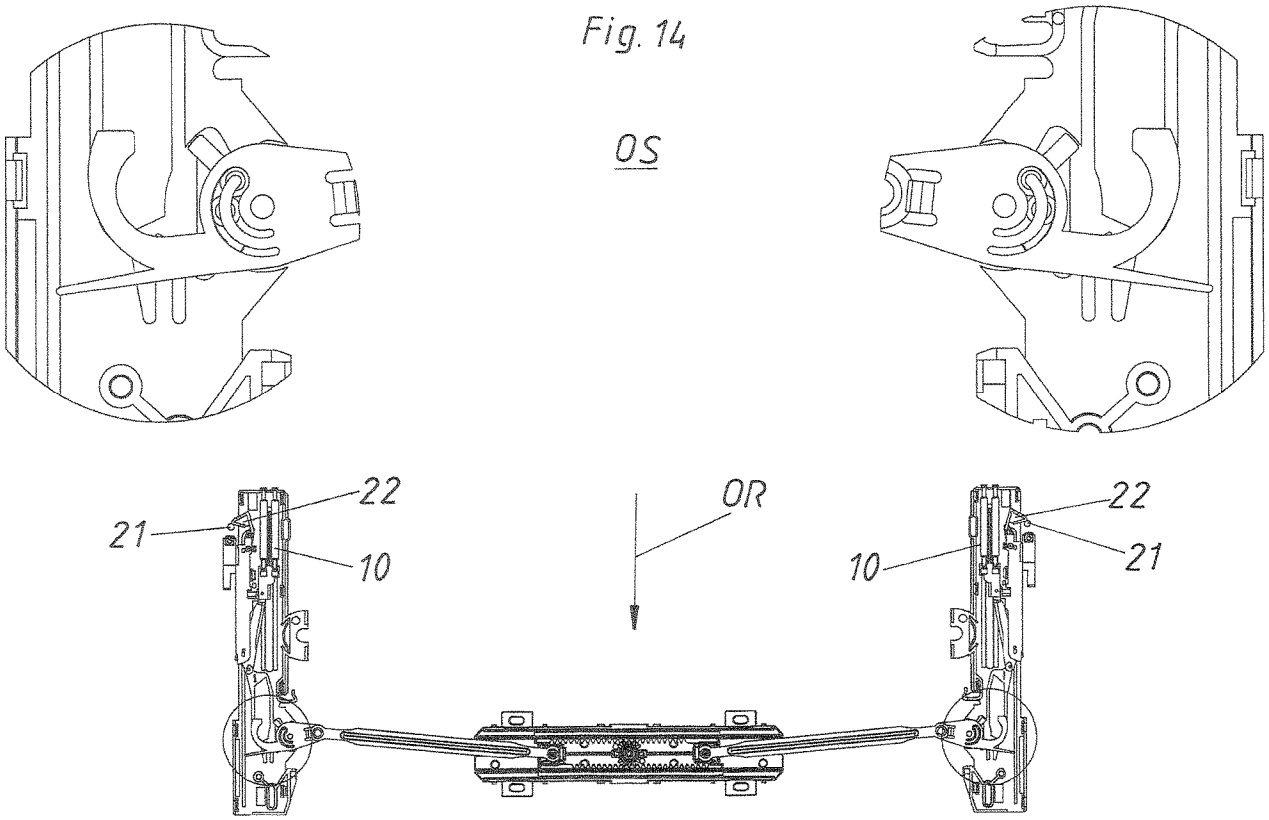

Then, due to momentum or by actively pulling on the moveable furniture part 3, the drive devices 2 and 7 pass into the position shown in FIG. 14. In that situation the control lever 23 and the transmission element 20 are no longer in contact. The catch lever 22 however is in the angled end portion 34 of the control track 24 whereby the entrainment member 21 is released. The moveable furniture part 3 is thus freely moveable.

Figure 15:
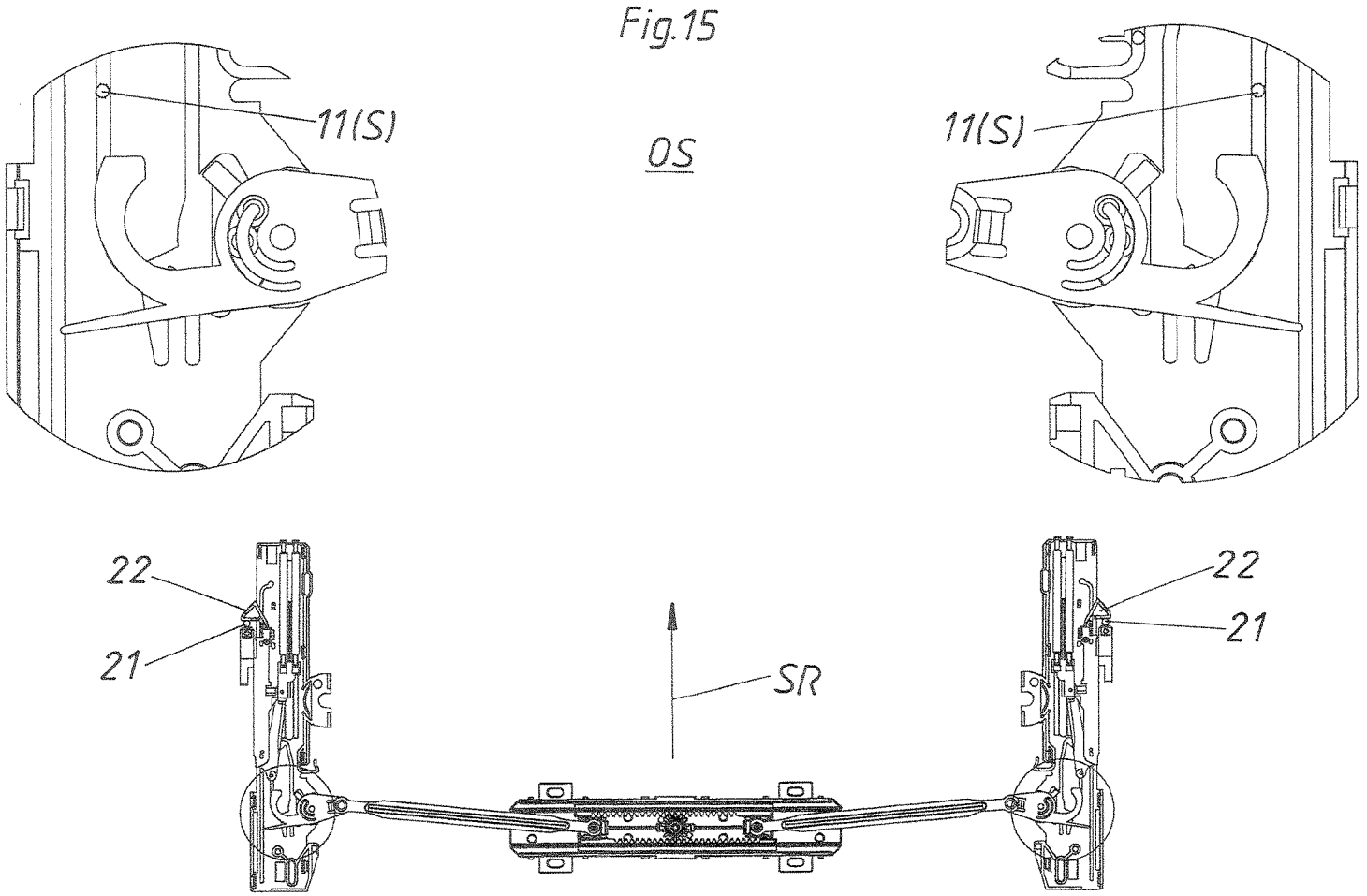

The closing process for the moveable furniture part 3 is shown as from FIG. 15. Here the entrainment member 21 is caught again and by way of the transmission element 20 the control lever 23 and with same the latching element 11 are in the stressing portion S whereby the ejection force storage devices 10 are manually stressed upon closure.

Figure 16:
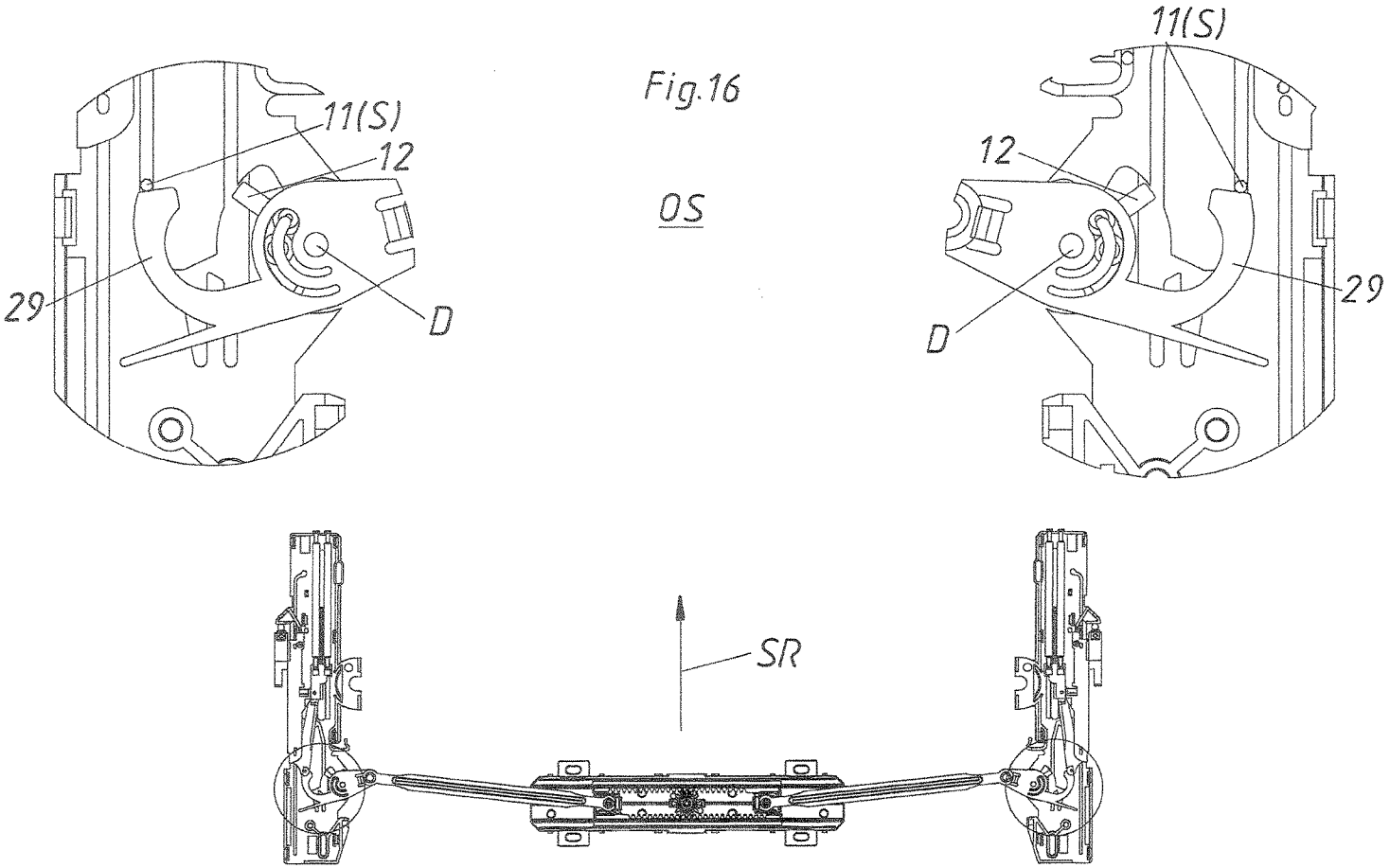
Figure 17:
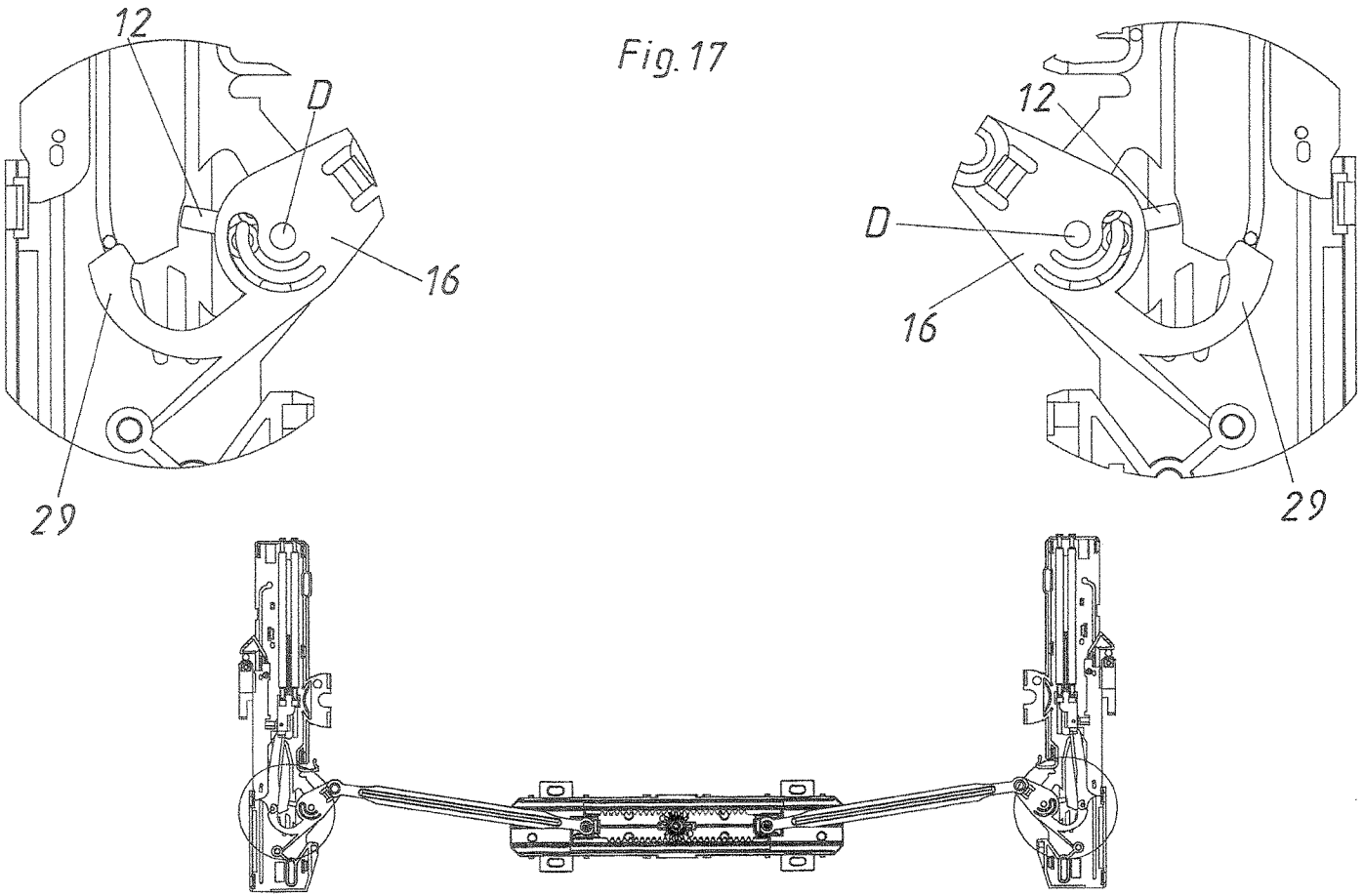

In that closing and stressing movement, both latching elements 11 as shown in FIG. 16 also come into butting relationship with the return levers 29 of the coupling elements 16. In that way, the coupling elements 16 are rotated about the axis of rotation so that as shown in FIG. 17 the locking elements 12 also move closer and closer in the direction of the locking portion V.

Figure 18:
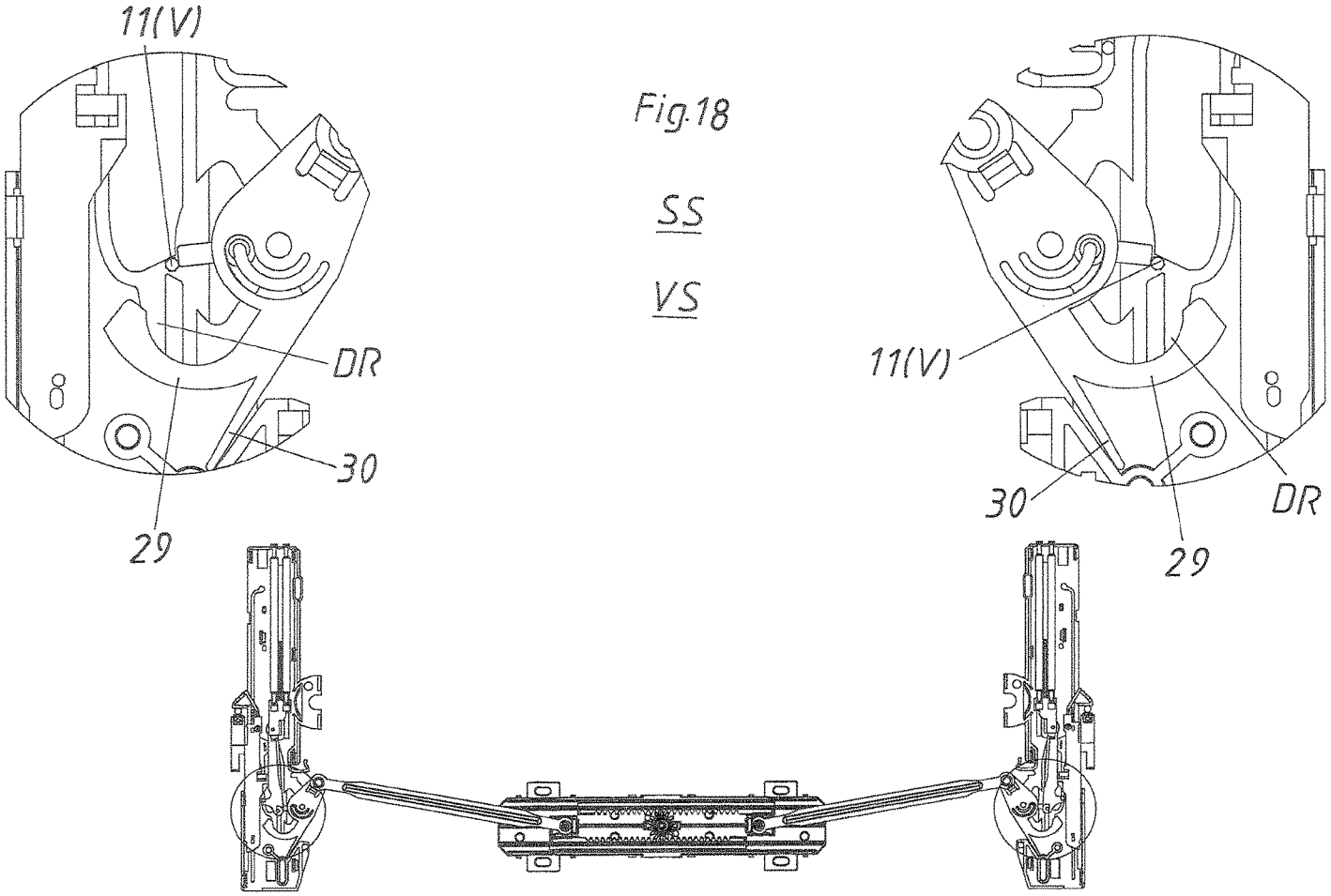

In FIG. 18, finally the coupling elements 16 are again in their starting position so that the locking surfaces 14 of the locking elements 12 again serve for locking the latching elements 11. The slightly elastic elements 30 of the coupling elements 16 provide for correct positioning (neutral position) of the locking elements 12 so that the locking elements 12 also form the latching depression or the locking portion V. The locking position VS of the ejection devices 4 is again reached with the ejection force storage devices 10 in a stressed condition. The moveable furniture part 3 is again in the closed position SS. To guarantee that the coupling element 16 remains in its position—after the latching element 11 is no longer in contact with the return lever 29 and before the latching element 11 again bears against the locking element 12—a small latching nose can be provided in the housing 8, the nose cooperating with the coupling element 16, preferably with its locking element 12.

Figure 19:
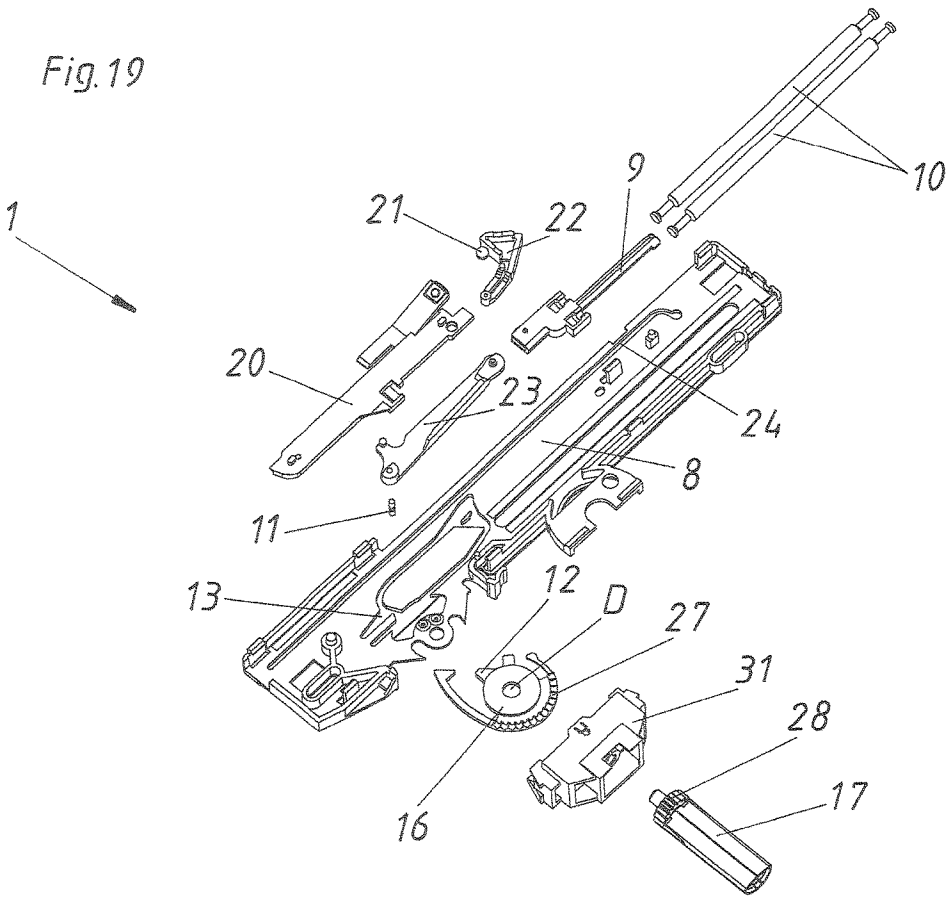
FIG. 19 is an exploded view of an alternative configuration of the arrangement.
Figure 21A:
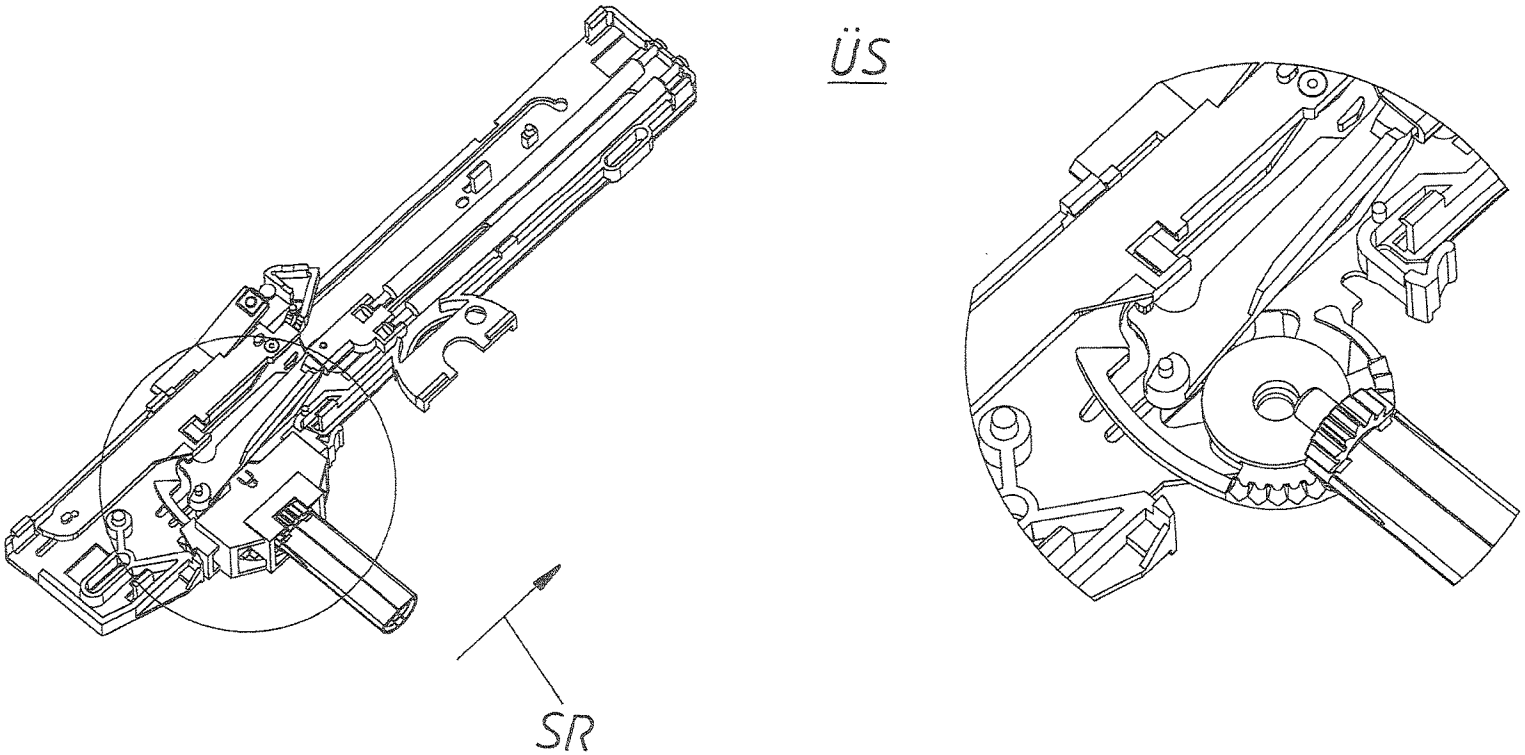
Figure 22A:
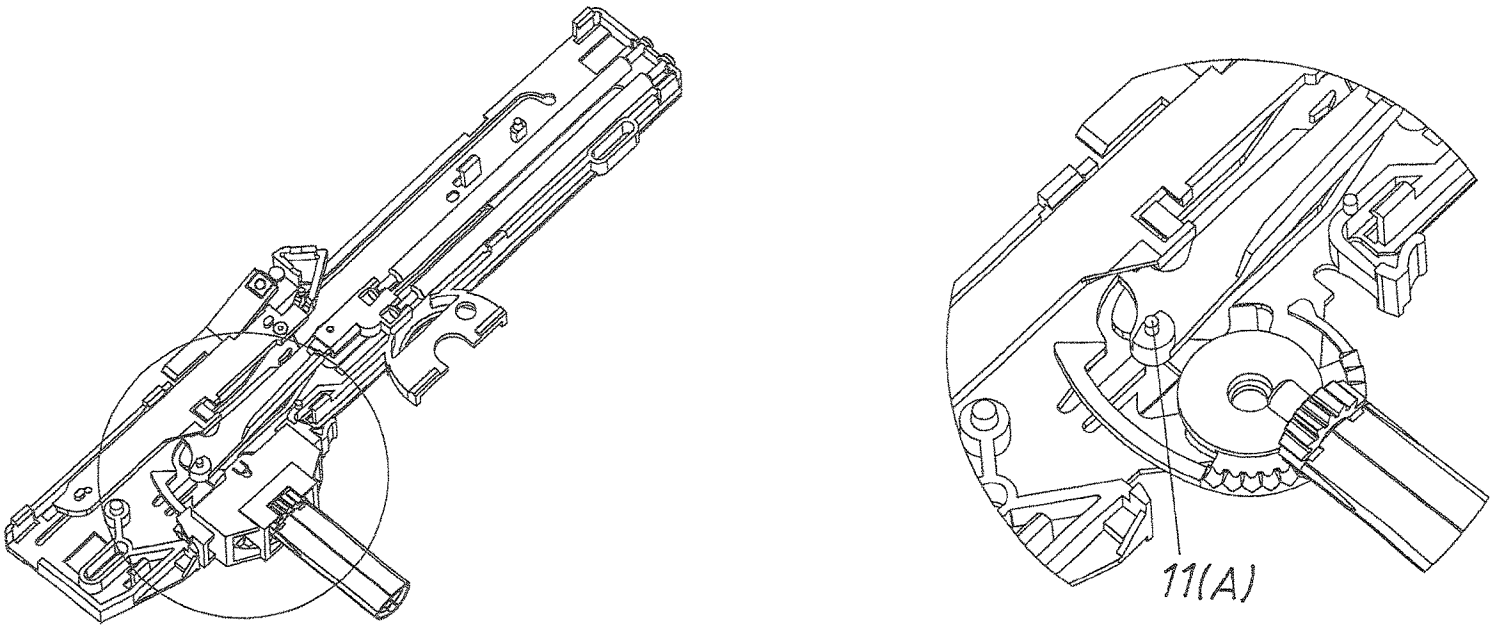
Figure 23:
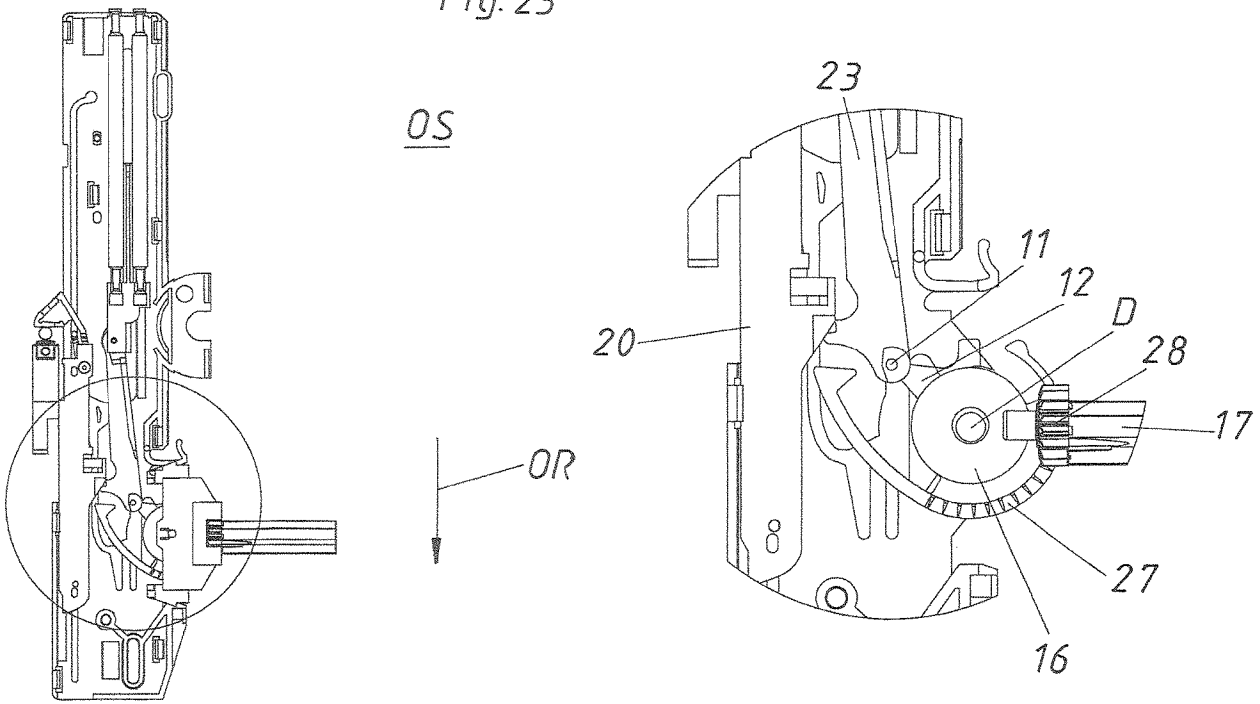
Figure 23A:
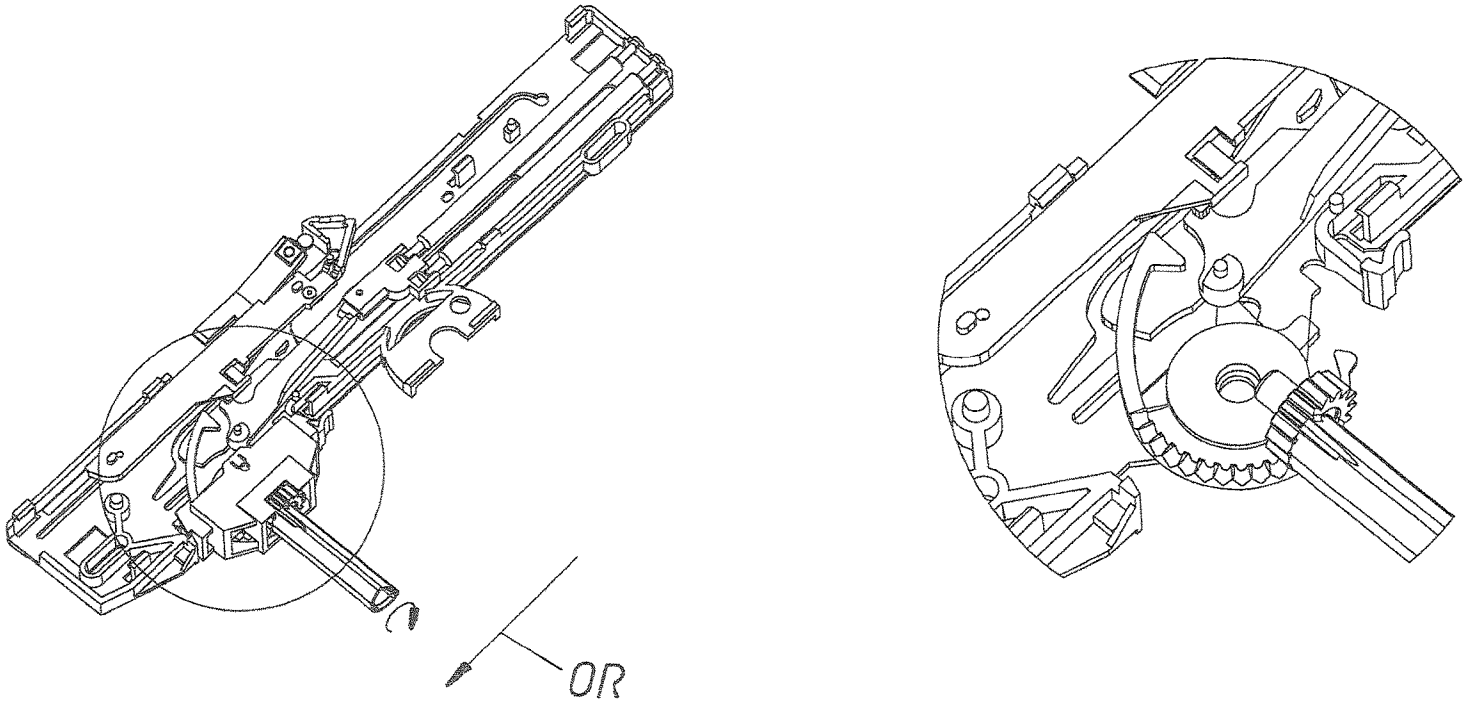

FIG. 19 shows an exploded view of an alternative embodiment of the synchronizing device 6. In accordance therewith, the toothed rack 27 is provided directly on the coupling element 16. Fixed to the housing 8 is a holder 31 to which the synchronizing bar 17 is rotatably mounted with a toothed gear 28 at the end thereof. The gear 28 meshes with the rack 27 so that a rotary movement of the coupling element 16 is transmitted into a rotary movement of the synchronizing bar 17—and vice-versa. The remaining components of the arrangement 1 in FIG. 19 are identical to the first embodiment.

FIGS. 20 through 23*a* again show the most important positions involved in the movements of the drive device 2 and 7 respectively and the synchronizing device 6. The rotary movement of the synchronizing bar 17 is most clearly shown in FIG. 23*a*.

The essential advantages of the present invention are:

- synchronization is activated only by the ejection process in respect of the side triggered at one side,
- the triggering force upon triggering at one side is half as great as with central triggering,
- the triggering travel is not increased by the synchronizing device,
- the triggering travel is not dependent on tolerances of the synchronizing device,
- actuation by pulling has no influence on the drive device and on the synchronizing device, and
- the front panel gap can be kept small.

The invention claimed is:

1. An arrangement comprising:

a first drive device configured to move a moveable furniture part, said first drive device including:

a lockable first ejection force storage device for ejecting the moveable furniture part from a closed position into an open position;

an attachment element to be mounted to the moveable furniture part such that said attachment element moves between an overpressing position, the closed position, and the open position with the moveable furniture part; and a first locking device for locking said first ejection force storage device in a locking position, said first ejection force storage device configured to be unlocked from the locking position by an overpressing movement of said attachment element into the overpressing position beyond the closed position; and a synchronizing device configured to synchronize said first drive device with a second drive device, said synchronizing device being moveable by said first drive device;

wherein said first drive device and said synchronizing device are configured and interconnected such that an entire unlocking process of said first ejection force storage device and at least an initial portion of the overpressing movement is free from any movement transmission between said first drive device and said synchronizing device and such that said synchronizing device is moveable upon a movement of said attachment element in an opening direction by said first ejection force storage device; and wherein said first drive device and said synchronizing device are configured and interconnected such that a transmission of movement from said first drive device to said synchronizing device occurs only after unlocking of said first ejection force storage device, the unlocking of said first ejection force storage device occurring during movement of said attachment element from the closed position to the overpressing position.

2. The arrangement as set forth in claim 1, wherein said synchronizing device is moveable by said first drive device only upon a movement of the moveable furniture part in the opening direction.

3. The arrangement as set forth in claim 1, wherein said synchronizing device is separate from the moveable furniture part.

4. The arrangement as set forth in claim 1, wherein said attachment element is a housing, said first ejection device includes:

an ejection slider displaceable on said housing, an ejection force storage device acting on said ejection slider, and a control lever mounted moveably to said ejection slider, wherein said first locking device has a latching element arranged on said control lever and a locking element against which said latching element bears in the locking position.

5. The arrangement as set forth in claim 4, wherein said control lever is mounted rotatably to said ejection slider.

6. The arrangement as set forth in claim 4, wherein said housing of said first drive device has a cardioid sliding track having an overpressing portion and an ejection portion, said latching element being moveable during the overpressing movement from the locking position into said overpressing portion of said cardioid sliding track and being moveable during the opening movement by the ejection force storage device through said ejection portion of said cardioid sliding track, wherein said locking element is configured to be moved by said latching element moving in said ejection portion in the opening direction.

7. The arrangement as set forth in claim 6, wherein said cardioid sliding track of said housing further has a stressing portion for guiding said latching element to stress said ejection force storage device and a locking portion, said locking element also forming said locking portion.

8. The arrangement as set forth in claim 6, wherein said locking element has:

a locking surface against which said latching element bears in the locking position, and a synchronizing surface against which said latching element bears during the movement through an ejection portion of said cardioid sliding track in the opening direction.

9. The arrangement as set forth in claim 8, wherein said locking surface is oriented substantially tangentially relative to a direction of rotation of said locking element, and said synchronizing surface is oriented substantially radially relative to an axis of rotation of said locking element.

10. The arrangement as set forth in claim 4, wherein said locking element is connected to said synchronizing device.

11. The arrangement as set forth in claim 10, wherein said locking element is connected to said synchronizing device in one piece therewith.

12. The arrangement as set forth in claim 4, wherein said locking element is mounted moveably to said housing.

13. The arrangement as set forth in claim 12, wherein said locking element is mounted rotatably to said housing.

14. The arrangement as set forth in claim 1, wherein said synchronizing device includes:

a coupling element for connecting said synchronizing device to said first drive device; and a synchronizing bar connected hingedly to said coupling element.

15. The arrangement as set forth in claim 14, wherein a locking element of said first locking device is formed as one piece with said coupling element.

16. The arrangement as set forth in claim 14, wherein said coupling element is rotatably mounted to a housing of said first ejection device.

17. The arrangement as set forth in claim 16, wherein a rotation of said coupling element is limited to an angle in a range of between 30 degrees and 90 degrees.

18. The arrangement as set forth in claim 17, wherein the rotation of said coupling element is limited to an angle in a range of between 40 degrees and 60 degrees.

19. The arrangement as set forth in claim 1, further comprising a lockable second drive device for moving the moveable furniture part.

20. The arrangement as set forth in claim 19, wherein said second drive device has a mirror-image symmetrical configuration relative to said first drive device.

21. The arrangement as set forth in claim 19, wherein said first drive device, said synchronizing device, and said second drive device are configured and interconnected such that, upon an overpressing movement of only a first one of said first drive device and said second drive device, said ejection device of a second one of said first drive device and said second drive device is unlockable from the locking position due to movement of said ejection device of said first one of said first drive device and said second drive device in the opening direction and due to movement transmission by said synchronizing device to said second one of said first drive device and said second drive device.

22. An article of furniture comprising:

a furniture carcass;

a furniture part moveable on said furniture carcass; and said arrangement as set forth in claim 1.

23. The article of furniture as set forth in claim 22, wherein said furniture carcass and said furniture part are configured such that a front panel gap of a maximum 3 mm remains between said moveable furniture part and said furniture carcass in the closed position.

24. The article of furniture as set forth in claim 23, wherein the front panel gap is a maximum 2 mm.

25. The arrangement as set forth in claim 1, wherein said attachment element is one of a housing or an entrainment member.

26. An arrangement comprising:

a first drive device configured to move a moveable furniture part, said first drive device including:

a lockable first ejection force storage device for ejecting the moveable furniture part from a closed position into an open position;

an attachment element to be mounted to the moveable furniture part such that said attachment element moves between an overpressing position, the closed position, and the open position with the moveable furniture part; and a first locking device for locking said first ejection force storage device in a locking position, said first ejection force storage device configured to be unlocked from the locking position by an overpressing movement of said attachment element into the overpressing position beyond the closed position; and a synchronizing device configured to synchronize said first drive device with a second drive device, said synchronizing device being moveable by said first drive device;

wherein said first drive device and said synchronizing device are configured and interconnected such that an entire unlocking process of said first ejection force storage device and at least an initial portion of the overpressing movement is free from any movement transmission between said first drive device and said synchronizing device and such that said synchronizing device is moveable upon a movement of said attachment element in an opening direction by said first ejection force storage device; and wherein said first drive device and said synchronizing device are configured and interconnected such that transmission of movement to said synchronizing device begins only upon said first ejection force storage device of said first drive device reaching a position corresponding to the closed position during movement in the opening direction from the overpressing position.

27. The arrangement as set forth in claim 26, wherein said attachment element is one of a housing or an entrainment member.

28. An arrangement comprising:

a first drive device configured to move a moveable furniture part, said first drive device including:

a lockable first ejection device for ejecting the moveable furniture part from a closed position into an open position, said first ejection device including:

a housing to be mounted to the moveable furniture part so as to move between the closed position, the open position, and an overpressing position with the moveable furniture part, an ejection slider displaceable on said housing, an ejection force storage device acting on said ejection slider, and a control lever mounted moveably to said ejection slider, and a first locking device for locking said first ejection device in a locking position, said first ejection device configured to be unlocked from the locking position by an overpressing movement of the moveable furniture part into the overpressing position beyond the closed position, said first locking device having a latching element arranged on said control lever of said first ejection device and a locking element against which said latching element bears in the locking position; and a synchronizing device configured to synchronize said first drive device with a second drive device, said synchronizing device being moveable by said first drive device;

wherein said first drive device and said synchronizing device are configured and interconnected such that the overpressing movement begins free from any movement transmission between said first drive device and said synchronizing device and such that said synchronizing device is moveable upon a movement of said housing in an opening direction by said first ejection device; and wherein said housing of said first ejection device has a cardioid sliding track having an overpressing portion and an ejection portion, said latching element being moveable during the overpressing movement from the locking position into said overpressing portion of said cardioid sliding track and being moveable during the opening movement by the ejection force storage device through said ejection portion of said cardioid sliding track, wherein said locking element is configured to be moved by said latching element moving in said ejection portion in the opening direction.

* * * * *